US011176954B2

(12) United States Patent
Vasilache et al.

(10) Patent No.: US 11,176,954 B2
(45) Date of Patent: Nov. 16, 2021

(54) ENCODING AND DECODING OF MULTICHANNEL OR STEREO AUDIO SIGNALS

(71) Applicant: Nokia Technologies Oy, Espoo (FI)

(72) Inventors: Adriana Vasilache, Tampere (FI); Anssi Ramo, Tampere (FI); Lasse Laaksonen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 167 days.

(21) Appl. No.: 16/604,279

(22) PCT Filed: Apr. 10, 2017

(86) PCT No.: PCT/FI2017/050256

§ 371 (c)(1),
(2) Date: Oct. 10, 2019

(87) PCT Pub. No.: WO2018/189414

PCT Pub. Date: Oct. 18, 2018

(65) Prior Publication Data

US 2020/0126575 A1 Apr. 23, 2020

(51) Int. Cl.

| | |
|---|---|
| ***G10L 19/00*** | (2013.01) |
| ***G10L 21/00*** | (2013.01) |
| ***G10L 21/04*** | (2013.01) |
| ***G10L 19/06*** | (2013.01) |

(Continued)

(52) U.S. Cl.

CPC ..... *G10L 19/06* (2013.01); *G10L 19/008* (2013.01); *G10L 19/032* (2013.01)

(58) Field of Classification Search

CPC ..... G10L 19/008; G10L 19/24; G10L 19/06; G10L 19/032; G10L 19/09; G10L 25/03; G10L 25/06; G10L 25/18

See application file for complete search history.

(56) References Cited

U.S. PATENT DOCUMENTS 8,768,691 B2 * 7/2014 Yoshida ..... G10L 19/008 704/223
2008/0010072 A1 * 1/2008 Yoshida ..... G10L 19/008 704/500

(Continued)

OTHER PUBLICATIONS

Vos et al, "Voice coding with Opus", 2013, InAudio Engineering Society Convention 135 Oct. 16, 2013. Audio Engineering Society, pp. 1-10.*

(Continued)

*Primary Examiner* — Olujimi A Adesanya
(74) *Attorney, Agent, or Firm* — Alston & Bird LLP

(57) ABSTRACT

A technique for encoding a multichannel audio encoding is provided that includes quantizing a set of first LP filter coefficients for an audio signal in a first channel using a predefined first quantizer; and quantizing a set of second LP filter coefficients for an audio signal in a second channel on the basis of the quantized set of first LP filter coefficients. The quantization of the set of second LP filter coefficients includes: deriving, on basis of the quantized set of first LP filter coefficients by using a predefined predictor, a set of predicted LP filter coefficients for the audio signal in said second channel, computing prediction error as a difference between respective LP coefficients of the set of second LP filter coefficients and the set of predicted LP filter coefficients, and quantizing the prediction error.

22 Claims, 8 Drawing Sheets

(51) Int. Cl.
*G10L 19/008* (2013.01)
*G10L 19/032* (2013.01)

(56) References Cited

U.S. PATENT DOCUMENTS

2008/0154583 A1* 6/2008 Goto ..... G10L 19/008 704/205
2008/0255832 A1* 10/2008 Goto ..... G10L 19/008 704/219
2009/0281798 A1* 11/2009 Den Brinker ..... G10L 19/008 704/219
2010/0106493 A1* 4/2010 Zhou ..... G10L 19/06 704/219
2010/0121633 A1* 5/2010 Chong ..... G10L 19/008 704/220
2010/0322429 A1* 12/2010 Norvell ..... G10L 19/24 381/22
2018/0233154 A1* 8/2018 Vaillancourt ..... G10L 19/09

OTHER PUBLICATIONS

Selten, "Stereo coding by two-channel linear prediction and rotation", 2004, Royal Philips Electronics NV, Philips Research, Eindhoven, The Netherlands. Oct. 2004, pp. 1-86.*

Ramprashad, "Stereophonic CELP coding using cross channel predictio", 2000, . In 2000 IEEE Workshop on Speech Coding. Proceedings. Meeting the Challenges of the New Millennium (Cat. No. 00EX421) Sep. 17, 2000 (pp. 136-138). IEEE.*

Aggarwal et al, "Optimal prediction in scalable coding of stereophonic audio", 2000, In Audio Engineering Society Convention 109 Sep. 1, 2000. Audio Engineering Society, pp. 1-10.*

"Coding of Speech at 16 kbit/s Using Low-delayCode Excited Linear Prediction", Series G: Transmission Systems and Media, Digital Systems and Networks, Digital terminal equipments—Coding of voice and audiosignals, Recommendation ITU-T G.728, Jun. 2012, 212 pages.

International Search Report and Written Opinion received for corresponding Patent Cooperation Treaty Application No. PCT/FI2017/050256, dated May 29, 2017, 10 pages.

Fuchs, "Improving Joint Stereo Audio Coding by Adaptive Interchannel Prediction", Proceedings of IEEE Workshop on Applications of Signal Processing to Audio and Acoustics, Oct. 17-20, 1993, 4 pages.

Biswas et al., "Stability of the Synthesis Filter in Stereo Linear Prediction", Annual Workshop on Circuits, Systems and Signal Processing (ProRISC), 2004, pp. 230-237.

* cited by examiner

ENCODING AND DECODING OF MULTICHANNEL OR STEREO AUDIO SIGNALS

RELATED APPLICATION

This application was originally filed as Patent Cooperation Treaty Application No. PCT/FI2017/050256 filed Apr. 10, 2017.

TECHNICAL FIELD

The example and non-limiting embodiments of the present invention relate to encoding and/or decoding of a multichannel or stereo audio signal.

BACKGROUND

In many applications, audio signals, such as speech or music, are encoded for example to enable efficient transmission or storage of the audio signals. In this regard, audio encoders and audio decoders (also known as audio codecs) are used to represent audio based signals, such as music and ambient sounds. These types of coders typically do not assume an audio input of certain characteristics and e.g. do not utilize a speech model for the coding process, rather they use processes that are suitable for representing all types of audio signals, including speech. In contrast, speech encoders and speech decoders (also known as speech codecs) can be considered to be audio codecs that are optimized for speech signals via utilization of a speech production model in the encoding-decoding process. Relying on the speech production model enables, for speech signals, a lower bit rate at perceivable sound quality comparable to that achievable by an audio codec or an improved perceivable sound quality at a bit rate comparable to that of an audio codec). On the other hand, since e.g. music and ambient sounds are typically a poor match with the speech production model, for a speech codec such signals typically represent background noise. An audio codec or a speech codec may operate at either a fixed or variable bit rate.

Audio encoders and decoders are often designed as low complexity source coders. In other words, they are able to perform encoding and decoding of audio signals without requiring extensive computational resources. This may be an essential characteristic especially for audio encoders and decoders that are employed for real-time services, such as telephony or live streaming of audio content and/or for audio encoders and decoders that are operated on mobile devices (or other devices) that have a limited capacity of computational resources available for disposal of the audio encoder and decoder.

For a speech codec, a typical speech production model builds on linear predictive coding (LPC), which enables accurate modeling of spectral envelope of the input audio signal 115 especially for input audio signals 115 that include a periodic or a quasi-periodic signal component. An outcome of LPC encoding in a speech encoder is a set of linear predictive (LP) coefficients that may be employed for speech synthesis in a speech decoder. In order to enable conveying the LP filter coefficients from the speech encoder to the speech decoder, the LP filter coefficients are encoded (e.g. quantized) and transferred in the encoded format to the speech decoder, where the received encoded LP filter coefficients are decoded (e.g. dequantized) and applied as coefficients of a LP synthesis filter.

The quantization of LP filter coefficients typically results in quantization error that may cause distortion in the reconstructed speech obtained from the LP synthesis filtering in the speech decoder. While the quantization error typically varies with characteristics of current speech input in the speech encoder, an average quantization error depends, among other things, on quantizer design and the number of bits available for quantization of LP filter coefficients. Consequently, especially at low bit-rates it is important to find a quantizer design that enables sufficiently low average quantization error while not consuming an excessive number of bits for quantization of the LP filter coefficients.

SUMMARY

According to an example embodiment, a method is provided, the method comprising obtaining a set of first linear prediction, LP, filter coefficients that represents a spectral envelope of an audio signal in a first channel derived from a multi-channel input audio signal; obtaining a set of second LP filter coefficients that represents a spectral envelope of an audio signal in a second channel derived from the multi-channel input audio signal; quantizing the set of first LP filter coefficients using a predefined first quantizer; and quantizing the set of second LP filter coefficients on basis of the quantized set of first LP filter coefficients, the quantization of the set of second LP filter coefficients comprising: deriving, on basis of the quantized set of first LP filter coefficients by using a predefined predictor, a set of predicted LP filter coefficients to estimate the spectral envelope of the audio signal in said second channel, computing prediction error as a difference between respective LP coefficients of the set of second LP filter coefficients and the set of predicted LP filter coefficients, and quantizing the prediction error using a predefined second quantizer.

According to another example embodiment, a method is provided, the method comprising obtaining a reconstructed set of first linear prediction, LP, filter coefficients that represents a spectral envelope of an audio signal in a first channel derived from a multi-channel input audio signal; and reconstructing a set of second LP filter coefficients that represents a spectral envelope of an audio signal in a second channel derived from the multi-channel input audio signal, said reconstructing comprising deriving, on basis of the quantized set of first LP filter coefficients by using a predefined predictor, a set of predicted LP filter coefficients to estimate the spectral envelope of the audio signal in said second channel, reconstructing prediction error on basis of one or more received codewords by using a predefined quantizer, and deriving a reconstructed set of second LP filter coefficients as a combination of the set of predicted LP filter coefficients and the reconstructed prediction error.

According to another example embodiment, an apparatus is provided, the apparatus configured to: obtain a set of first linear prediction, LP, filter coefficients that represents a spectral envelope of an audio signal in a first channel derived from a multi-channel input audio signal; obtain a set of second LP filter coefficients that represents a spectral envelope of an audio signal in a second channel derived from the multi-channel input audio signal; quantize the set of first LP filter coefficients using a predefined first quantizer; and quantize the set of second LP filter coefficients on basis of the quantized set of first LP filter coefficients, the quantization of the set of second LP filter coefficients comprising: deriving, on basis of the quantized set of first LP filter coefficients by using a predefined predictor, a set of predicted LP filter coefficients to estimate the spectral envelope of the audio signal in said second channel, computing prediction error as a difference between respective LP coefficients of the set of second LP filter coefficients and the set of predicted LP filter coefficients, and quantizing the prediction error using a predefined second quantizer.

According to another example embodiment, an apparatus is provided, the apparatus configured to: obtain a reconstructed set of first linear prediction, LP, filter coefficients that represents a spectral envelope of an audio signal in a first channel derived from a multi-channel input audio signal; and reconstruct a set of second LP filter coefficients that represents a spectral envelope of an audio signal in a second channel derived from the multi-channel input audio signal, said reconstructing comprising deriving, on basis of the quantized set of first LP filter coefficients by using a predefined predictor, a set of predicted LP filter coefficients to estimate the spectral envelope of the audio signal in said second channel, reconstructing prediction error on basis of one or more received codewords by using a predefined quantizer, and deriving a reconstructed set of second LP filter coefficients as a combination of the set of predicted LP filter coefficients and the reconstructed prediction error.

According to another example embodiment, an apparatus is provided, the apparatus comprising means for obtaining a set of first linear prediction, LP, filter coefficients that represents a spectral envelope of an audio signal in a first channel derived from a multi-channel input audio signal; means for obtaining a set of second LP filter coefficients that represents a spectral envelope of an audio signal in a second channel derived from the multi-channel input audio signal; means for quantizing the set of first LP filter coefficients using a predefined first quantizer; and means for quantizing the set of second LP filter coefficients on basis of the quantized set of first LP filter coefficients, the means for quantizing the set of second LP filter coefficients configured to: derive, on basis of the quantized set of first LP filter coefficients by using a predefined predictor, a set of predicted LP filter coefficients to estimate the spectral envelope of the audio signal in said second channel, compute prediction error as a difference between respective LP coefficients of the set of second LP filter coefficients and the set of predicted LP filter coefficients, and quantize the prediction error using a predefined second quantizer.

According to another example embodiment, an apparatus is provided, the apparatus comprising means for obtaining a reconstructed set of first linear prediction, LP, filter coefficients that represents a spectral envelope of an audio signal in a first channel derived from a multi-channel input audio signal; and means for reconstructing a set of second LP filter coefficients that represents a spectral envelope of an audio signal in a second channel derived from the multi-channel input audio signal, the means for reconstructing configured to: derive, on basis of the quantized set of first LP filter coefficients by using a predefined predictor, a set of predicted LP filter coefficients to estimate the spectral envelope of the audio signal in said second channel, reconstruct prediction error on basis of one or more received codewords by using a predefined quantizer, and derive a reconstructed set of second LP filter coefficients as a combination of the set of predicted LP filter coefficients and the reconstructed prediction error.

According to another example embodiment, an apparatus is provided, wherein the apparatus comprises at least one processor; and at least one memory including computer program code, which when executed by the at least one processor, causes the apparatus to: obtain a set of first linear prediction, LP, filter coefficients that represents a spectral envelope of an audio signal in a first channel derived from a multi-channel input audio signal; obtain a set of second LP filter coefficients that represents a spectral envelope of an audio signal in a second channel derived from the multi-channel input audio signal; quantize the set of first LP filter coefficients using a predefined first quantizer; and quantize the set of second LP filter coefficients on basis of the quantized set of first LP filter coefficients, the quantization of the set of second LP filter coefficients comprising: deriving, on basis of the quantized set of first LP filter coefficients by using a predefined predictor, a set of predicted LP filter coefficients to estimate the spectral envelope of the audio signal in said second channel, computing prediction error as a difference between respective LP coefficients of the set of second LP filter coefficients and the set of predicted LP filter coefficients, and quantizing the prediction error using a predefined second quantizer.

According to another example embodiment, an apparatus is provided, wherein the apparatus comprises at least one processor; and at least one memory including computer program code, which when executed by the at least one processor, causes the apparatus to: obtain a reconstructed set of first linear prediction, LP, filter coefficients that represents a spectral envelope of an audio signal in a first channel derived from a multi-channel input audio signal; and reconstruct a set of second LP filter coefficients that represents a spectral envelope of an audio signal in a second channel derived from the multi-channel input audio signal, said reconstructing comprising deriving, on basis of the quantized set of first LP filter coefficients by using a predefined predictor, a set of predicted LP filter coefficients to estimate the spectral envelope of the audio signal in said second channel, reconstructing prediction error on basis of one or more received codewords by using a predefined quantizer, and deriving a reconstructed set of second LP filter coefficients as a combination of the set of predicted LP filter coefficients and the reconstructed prediction error.

According to another example embodiment, a computer program is provided, the computer program comprising computer readable program code configured to cause performing at least a method according to the example embodiment described in the foregoing when said program code is executed on a computing apparatus.

The computer program according to an example embodiment may be embodied on a volatile or a non-volatile computer-readable record medium, for example as a computer program product comprising at least one computer readable non-transitory medium having program code stored thereon, the program which when executed by an apparatus cause the apparatus at least to perform the operations described hereinbefore for the computer program according to an example embodiment of the invention.

The exemplifying embodiments of the invention presented in this patent application are not to be interpreted to pose limitations to the applicability of the appended claims. The verb "to comprise" and its derivatives are used in this patent application as an open limitation that does not exclude the existence of also unrecited features. The features described hereinafter are mutually freely combinable unless explicitly stated otherwise.

Some features of the invention are set forth in the appended claims. Aspects of the invention, however, both as to its construction and its method of operation, together with additional objects and advantages thereof, will be best understood from the following description of some example embodiments when read in connection with the accompanying drawings.

BRIEF DESCRIPTION OF FIGURES

The embodiments of the invention are illustrated by way of example, and not by way of limitation, in the figures of the accompanying drawings, where.

DESCRIPTION OF SOME EMBODIMENTS

Figure 1:
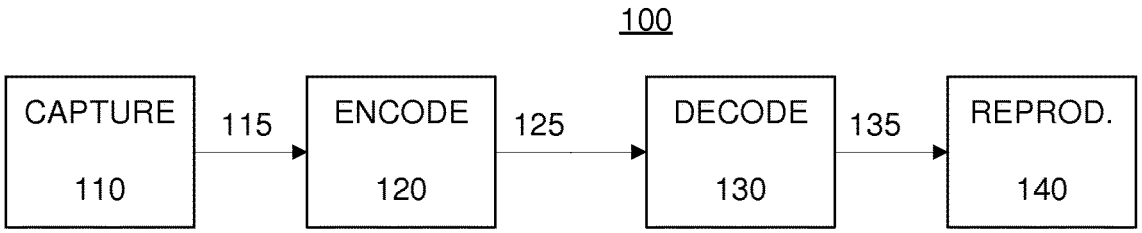
FIG. 1 illustrates a block diagram of some components and/or entities of an audio processing system according to an example.

FIG. 1 illustrates a block diagram of some components and/or entities of an audio processing system 100 that may serve as framework for various embodiments of the audio coding technique described in the present disclosure. The audio processing system 100 comprises an audio capturing entity 110 for recording an input audio signal 115 that represents at least one sound, an audio encoding entity 120 for encoding the input audio signal 115 into an encoded audio signal 125, an audio decoding entity 130 for decoding the encoded audio signal 125 obtained from the audio encoding entity into a reconstructed audio signal 135, and an audio reproduction entity 140 for playing back the reconstructed audio signal 135.

The audio capturing entity 110 serves to produce the input audio signal 115 as a two-channel stereo audio signal. In this regard, the audio capturing entity 110 comprises a microphone assembly that may comprise a stereo microphone, an arrangement of two microphones or a microphone array. The audio capturing entity 110 may further include processing means for recording a pair of digital audio signals that represent the sound captured by the microphone assembly pair of sound signals and that constitute the left and right channels of the input audio signal 115 provided as stereo audio signal. The audio capturing entity 110 provides the input audio signal 115 so obtained to the audio encoding entity 120 and/or for storage in a storage means for subsequent use.

The audio encoding entity 120 employs an audio coding algorithm, referred herein to as an audio encoder, to process the input audio signal 115 into the encoded audio signal 125. In this regard, the audio encoder may be considered to implement a transform from a signal domain (the input audio signal 115) to the compressed domain (the encoded audio signal 125). The audio encoding entity 120 may further include a pre-processing entity for processing the input audio signal 115 from a format in which it is received from the audio capturing entity 110 into a format suited for the audio encoder. This pre-processing may involve, for example, level control of the input audio signal 115 and/or modification of frequency characteristics of the input audio signal 115 (e.g. low-pass, high-pass or bandpass filtering). The pre-processing may be provided as a pre-processing entity that is separate from the audio encoder, as a sub-entity of the audio encoder or as a processing entity whose functionality is shared between a separate pre-processing and the audio encoder.

The audio decoding entity 130 employs an audio decoding algorithm, referred herein to as an audio decoder, to process the encoded audio signal 125 into the reconstructed audio signal 135. The audio decoder may be considered to implement a transform from an encoded domain (the encoded audio signal 125) back to the signal domain (the reconstructed audio signal 135). The audio decoding entity 130 may further include a post-processing entity for processing the reconstructed audio signal 115 from a format in which it is received from the audio decoder into a format suited for the audio reproduction entity 140. This post-processing may involve, for example, level control of the reconstructed audio signal 135 and/or modification of frequency characteristics of the reconstructed audio signal 135 (e.g. low-pass, high-pass or bandpass filtering). The post-processing may be provided as a post-processing entity that is separate from the audio decoder, as a sub-entity of the audio decoder or as a processing entity whose functionality is shared between a separate post-processing and the audio decoder.

The audio reproduction entity 140 may comprise, for example, headphones, a headset, a loudspeaker or an arrangement of one or more loudspeakers.

Instead of an arrangement where the audio encoding entity 120 receives the input audio signal 115 (directly) from the audio capturing entity 110, the audio processing system 100 may include a storage means for storing pre-captured or pre-created audio signals, among which the audio input signal 115 for provision to the audio encoding entity 120 may be selected.

Instead of an arrangement where the audio decoding entity 130 provides the reconstructed audio signal 135 (directly) to the audio reproduction entity 140, the audio processing system 100 may comprise a storage means for storing the reconstructed audio signal 135 provided by the audio decoding entity 130 for subsequent analysis, processing, playback and/or transmission to a further entity.

The dotted vertical line in FIG. 1 serves to denote that, typically, the audio encoding entity 120 and the audio decoding entity 130 may be provided in separate devices that may be connected to each other via a network or via a transmission channel. The network/channel may provide a wireless connection, a wired connection or a combination of the two between the audio encoding entity 120 and the audio decoding entity 130. As an example in this regard, the audio encoding entity 120 may further comprise a (first) network interface for encapsulating the encoded audio signal 125 into a sequence of protocol data units (PDUs) for transfer to the decoding entity 130 over a network/channel, whereas the audio decoding entity 130 may further comprise a (second) network interface for decapsulating the encoded audio signal 125 from the sequence of PDUs received from the audio encoding entity 120 over the network/channel.

Figure 2:
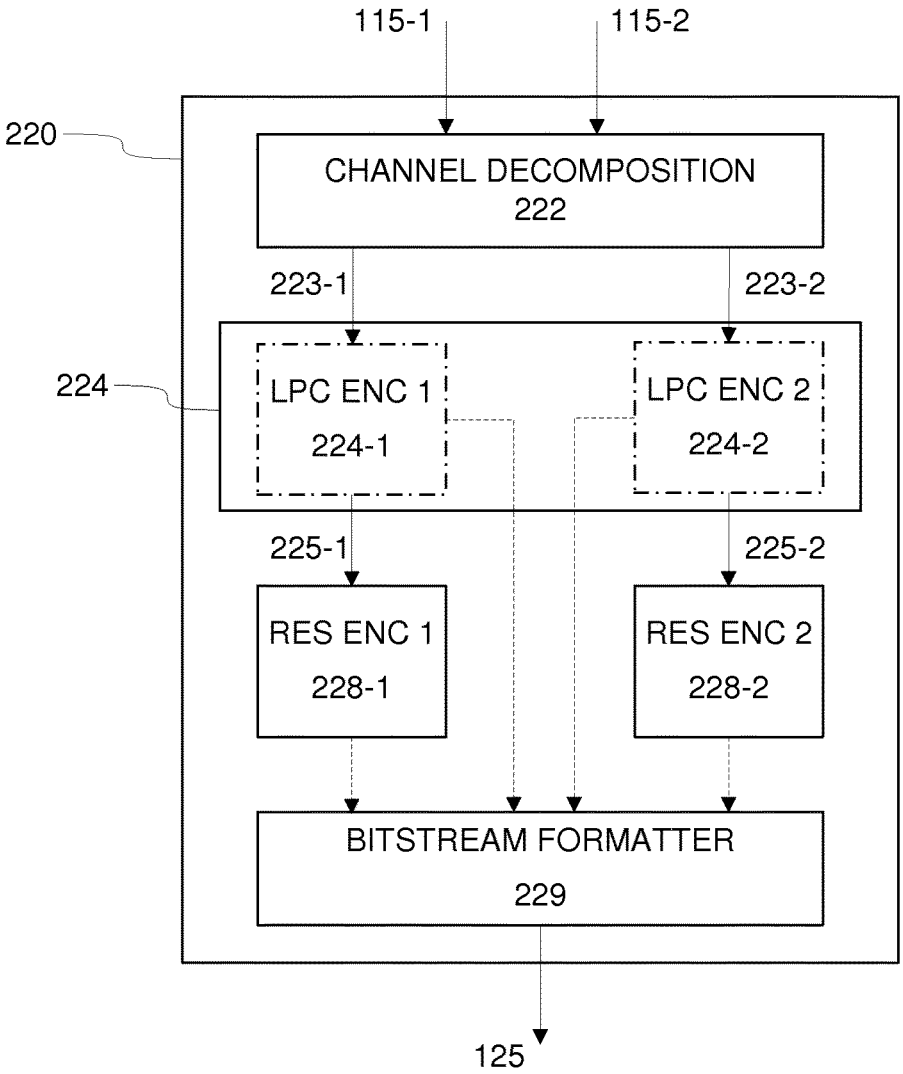
FIG. 2 illustrates a block diagram of some components and/or entities of an audio encoder according to an example.

In the following, some aspects of a LPC encoding and a LP parameter quantization technique are described in a framework of an exemplifying audio encoder 220. In this regard, FIG. 2 illustrates a block diagram of some components and/or entities of the audio encoder 220. The audio encoder 220 may be provided, for example, as the audio encoding entity 120 or as a part thereof.

The audio encoder 220 carries out encoding of the input audio signal 115 into the encoded audio signal 125. In other words, the audio encoder 220 implements a transform from the signal domain (e.g. time domain) to the encoded domain. As described in the foregoing, the input audio signal 115 comprises two digital audio signals, received at the audio encoder 220 as a left channel 115-1 and a right channel 115-2. The audio encoder 220 may be arranged to process the input audio signal 115 arranged into a sequence of input frames, each input frame including a respective segment of digital audio signal for the left channel 115-1 and for the right channel 115-2 provided as a respective time series of input samples at a predefined sampling frequency.

Typically, the audio encoder 220 employs a fixed predefined frame length. In other examples, the frame length may be a selectable frame length that may be selected from a plurality of predefined frame lengths, or the frame length may be an adjustable frame length that may be selected from a predefined range of frame lengths. A frame length may be defined as number samples L included in the frame for each of the left channel 115-1 and the right channel 115-2, which at the predefined sampling frequency maps to a corresponding duration in time. As an example in this regard, the audio encoder 220 may employ a fixed frame length of 20 milliseconds (ms), which at a sampling frequency of 8, 16, 32 or 48 kHz results in a frame of L=160, L=320, L=640 and L=960 samples per channel, respectively. These values, however, serve as non-limiting examples and frame lengths and/or sampling frequencies different from these examples may be employed instead, depending e.g. on the desired audio bandwidth, on desired framing delay and/or on available processing capacity.

The audio encoder 220 processes in the left channel 115-1 and the right cannel 115-2 of input audio signal 115 through a channel decomposer 222 that serves to decompose the input audio signal 115 into a first channel 223-1 and a second channel 223-2 that are processed through a LPC encoder 224, which at least conceptually includes a first LPC encoder 224-1 and a second LPC encoder 224-2. The first channel 223-1 is processed through the first LPC encoder 224-1 and a first residual encoder 228-1, whereas the second channel 223-2 is processed through the second LPC encoder 224-2 and a second residual encoder 228-2. Both in a first signal path through the first LPC encoder 224-1 and the first residual encoder 228-1 and in a second signal path through the second LPC encoder 224-2 and the second residual encoder 228-2 the signal is processed frame by frame.

The channel decomposer 222 serves to decompose a frame of the input audio signal 115 into corresponding frames of the first channel 223-1 and the second channel 223-2. The decomposition process may be a predefined one or the decomposition may be carried out in dependence of one or more characteristics of the frame of the input audio signal 115.

As an example of a predefined decomposition, the classic mid/side decomposition may be used, e.g. such that a mid signal derived as a sum signal of the signals in the left channel 115-1 and the right channel 115-2 is provided as the first channel 223-1 signal and a side signal derived as a difference signal between the signals in the left channel 115-1 and the right channel 115-2 is provided as the second channel 223-2 signal. In a variation of such decomposition, the sum signal may be scaled with a first predefined scaling factor and the difference signal may be scaled with a second predefined scaling factor before provision as respective signals of the first channel 223-1 and the second channel 223-2, e.g. such that both the first and second scaling factors have the value 0.5. In a further example, predefined one of the left channel 115-1 and the right channel 115-2 may be provided as the first channel 223-1 signal whereas the other one is provided as the second channel 223-2 signal.

As an example of decomposition that depends on one or more characteristics of the input audio signal 115, the signal for the first channel 223-1 may be derived on basis of the one of the left channel 115-1 signal and the right channel 115-2 signal that has a higher energy whereas the signal for the second channel 223-2 may be derived on basis of the other one of the left channel 115-1 and right channel 115-2 signals. The derivation may comprise, for example, predefined or adaptive scaling and/or filtering of the respective one of the left channel 115-1 and right channel 115-2 signals. In a variation of this example, the higher-energy one of the left channel 115-1 and the right channel 115-2 signals may be provided as such as the first channel 223-1 signal while the other one is provided as such as the second channel 223-2 signal.

In a further example in this regard, the first channel 223-1 signal is provided as a sum signal of the signals in the left channel 115-1 and the right channel 115-2 and the second channel 223-2 signal is provided as a difference signal between the signals in the left channel 115-1 and the right channel 115-2, wherein the sum and difference signals are scaled, respectively, by first and second scaling factors that are adaptively selected in dependence of signal energy in the left channel 115-1 and/or in the right channel 115-2, preferably such that the sum of the first and second scaling factors is substantially one. In case a decomposition that depends on one or more characteristics of the input audio signal 115 is applied, an indication of the employed manner of decomposing the left and right channels 115-1, 115-2 into the first and second channels 223-1, 223-2 may be provided to a bitstream formatter 229 for inclusion in the encoded audio signal 125.

In view of the foregoing examples, the channel decomposer 222 operates to decompose a frame of the input audio signal 115 into corresponding frames of the first channel 223-1 and the second channel 223-2, where the first channel 223-1 conveys a larger portion of the energy carried by the channels 115-1, 115-2 of the input audio signal 115 in comparison to the second channel 223-2. Therefore, the first channel 223-1 may be referred to as primary channel, whereas the second channels 223-2 may be referred to as a secondary channel.

The LPC coding in general is a coding technique well known in the art and it makes use of short-term redundancies in the signal of the respective one of the channels 223-1, 223-2 to derive a set of LP filter coefficients that are descriptive of a spectral envelope in the signal of the respective channel 223-1, 223-2. As a brief overview, the LPC encoding may involve LP analysis to derive the set of LP filter coefficients, LP analysis filtering that makes use of the derived set of LP filter coefficient to process the signal in the respective channel 223-1, 223-2 into corresponding residual signal, and encoding of the derived LP filter coefficients for transmission to a LPC decoder to enable LP synthesis therein.

The LPC encoder 224, e.g. the first LPC encoder 224-1, carries out an LPC encoding procedure to process a frame of the signal in the first channel 223-1 into a corresponding frame of a first residual signal 225-1, which is provided as input to the first residual encoder 228-1 for residual encoding therein. As part of the LPC encoding procedure the first LPC encoder 224-1 applies LP analysis to derive a set of first LP filter coefficients that are descriptive of a spectral envelope of in the frame of the signal in first channel 223-1. The first LPC encoder 224-1 quantizes and encodes the derived first LP filter coefficients and further provides the encoded first LP filter coefficients as part of encoded LPC parameters to the bitstream formatter 229 for inclusion in the encoded audio signal 125, thereby including in the encoded LPC parameters information that is useable in an audio decoder to reconstruct the first LP filter coefficients for LP synthesis filtering therein.

The LPC encoder 224, e.g. the second LPC encoder 224-2, carries out an LPC encoding procedure to process a frame of the signal in the second channel 223-2 into a corresponding frame of a second residual signal 225-2, which is provided as input to the second residual encoder 228-1 for residual encoding therein. As part of the LPC encoding procedure the second LPC encoder 224-2 applies LP analysis to derive a set of second LP filter coefficients that are descriptive of a spectral envelope in the frame of the signal in the second channel 223-2. The second LPC encoder 224-2 quantizes and encodes the derived second LP filter coefficients and further provides the encoded second LP filter coefficients as part of the encoded LPC parameters to the bitstream formatter 229 for inclusion in the encoded audio signal 125, thereby including in the encoded LPC parameters information that is useable in the audio decoder to reconstruct the second LP filter coefficients for LP synthesis filtering therein.

Figure 3:
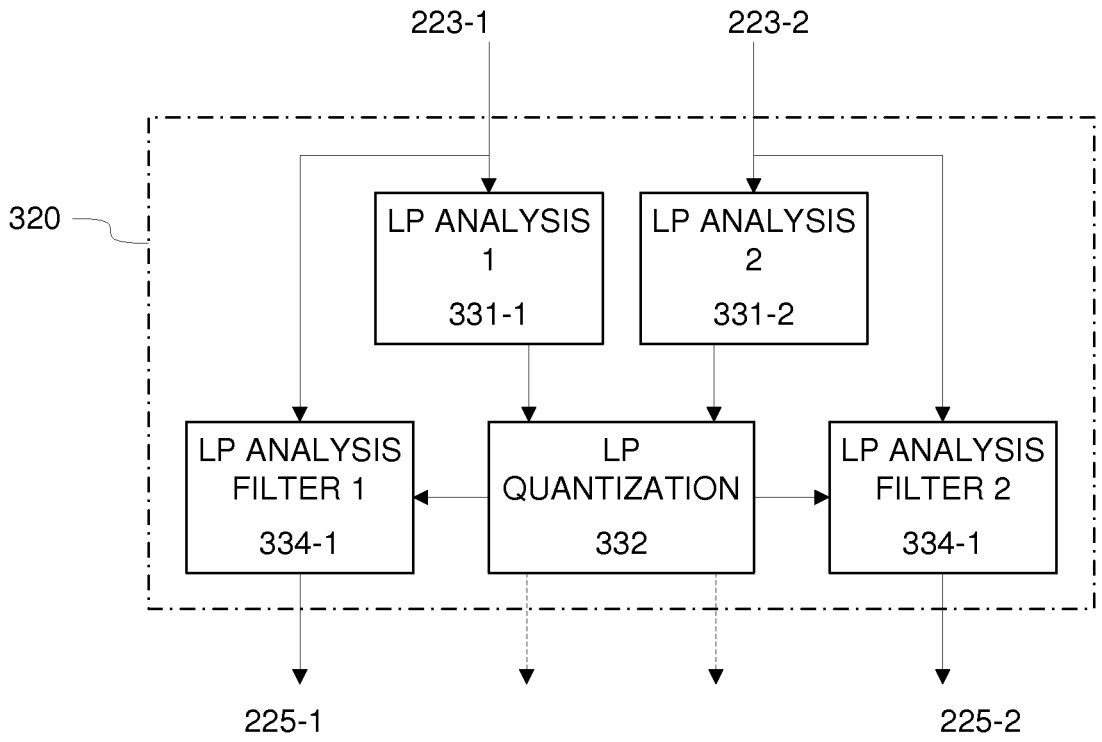
FIG. 3 illustrates a block diagram of some components and/or entities of a LPC encoder according to an example.

As an example of the LPC encoder 224, FIG. 3 illustrates a block diagram of some components and/or entities of a LPC encoder 320 that may be employed, for example, as the LPC encoder 224 or as a part thereof in the framework of FIG. 2.

In the LPC encoder 320 first LP analyzer 331-1 carries out an LP analysis on basis of a frame of the first channel 223-1, thereby providing the set of first LP filter coefficients, whereas a second LP analyzer 331-2 carries out an LP analysis on basis of a frame of the second channel 223-2, thereby providing the set of second LP filter coefficients. In the LP analysis, the respective one of the first and second LP analyzers 331-1, 331-2 may determine the respective set of the first and second LP filter coefficients e.g. by separately minimizing an error term $e_1(t)$ for the first channel 223-1 and an error term $e_2(t)$ for the second channel 223-2:

$$e_1(t)=\|\Sigma_{i=0}^{M}a_{1,i}x_1(t-i)\|,t=t+1:t+N_{lpc},$$

$$e_2(t)\|\Sigma_{i=0}^{M}a_{2,i}x_2(t-i)\|,t=t+1:t+N_{lpc} \quad (1)$$

where $a_{1,i}$, i=0:M, $a_{1,0}=1$ denote the set of first LP filter coefficients, $a_{2,i}$, i=0:M, $a_{2,0}=1$ denote the set of second LP filter coefficients, $N_{lpc}$ denotes the analysis window length (in number of samples), $x_1(t)$, $t=t-N_{LPC}$:t denotes the first channel 223-1 signal, $x_2(t)$, $t=t-N_{LPC}$:t denotes the second channel 223-2 signal, and the symbol ||•|| denotes an applied norm, e.g. the Euclidean norm. The resulting sets of the first LP filter coefficients $a_{1,i}$ and the second LP filter coefficients $a_{2,i}$ are passed for the LP quantizer 332 for LP quantization and encoding therein.

In an example, the first and second LP analyzers 331-1, 331-2 employ a predefined LP analysis window length $N_{lpc}$, implying that the LP analysis is based on $N_{lpc}$ consecutive samples of the signal in the respective channel 223-1, 223-2. Typically, this implies carrying out the LP analysis based on $N_{lpc}$ most recent samples of the signal in the respective channel 223-1, 223-2 including the L samples of the current frame. In addition to the L samples of the current frame, the LP analysis window may cover samples that precede the current frame in time and/or that follow the current frame in time (where the latter is commonly referred to as look-ahead). As a non-limiting example, the LP analysis window may cover 25 ms, including 6.25 ms of past signal that immediately precedes the current frame, the current frame (of 10 ms), and a look-head of 8.75 ms. The LP analysis window has a predefined shape, which may be selected in view of desired LP analysis characteristics. Several suitable LP analysis windows are known in the art, e.g. a (modified) Hamming window and a (modified) Hanning window, as well as hybrid windows such as one specified in the ITU-T Recommendation G.728 (section 3.3).

The LPC encoder 320 employs a predefined LP model order, denoted as M, resulting in M LP filter coefficients in each of the set of first LP filter coefficients and the set of second LP filter coefficients. In general, a higher LP model order M enables a more accurate modeling of the spectral envelope, while on the other hand a higher model order requires a higher number of bits for encoding the quantized LP filter coefficients and incurs a higher computational load. Therefore, selection of the most appropriate LP model order M for a given use case may involve a trade-off between the desired accuracy of modeling the spectral envelope, the available number of bits and the available computational resources. As a non-limiting example, the LP model order M may be selected as a value between 10 and 20, e.g. as M=16.

The LP quantizer 332 receives the respective sets of the first LP filter coefficients $a_{1,i}$ and the second LP filter coefficients $a_{2,i}$ from the first and second LP analyzers 331-1, 332-2 and operates to derive quantized first LP filter coefficients $\tilde{a}_{1,i}$ and quantized second LP filter coefficients $\tilde{a}_{2,i}$ and respective encoded versions thereof. Examples of the quantization procedure are provided in the following.

Figure 4:
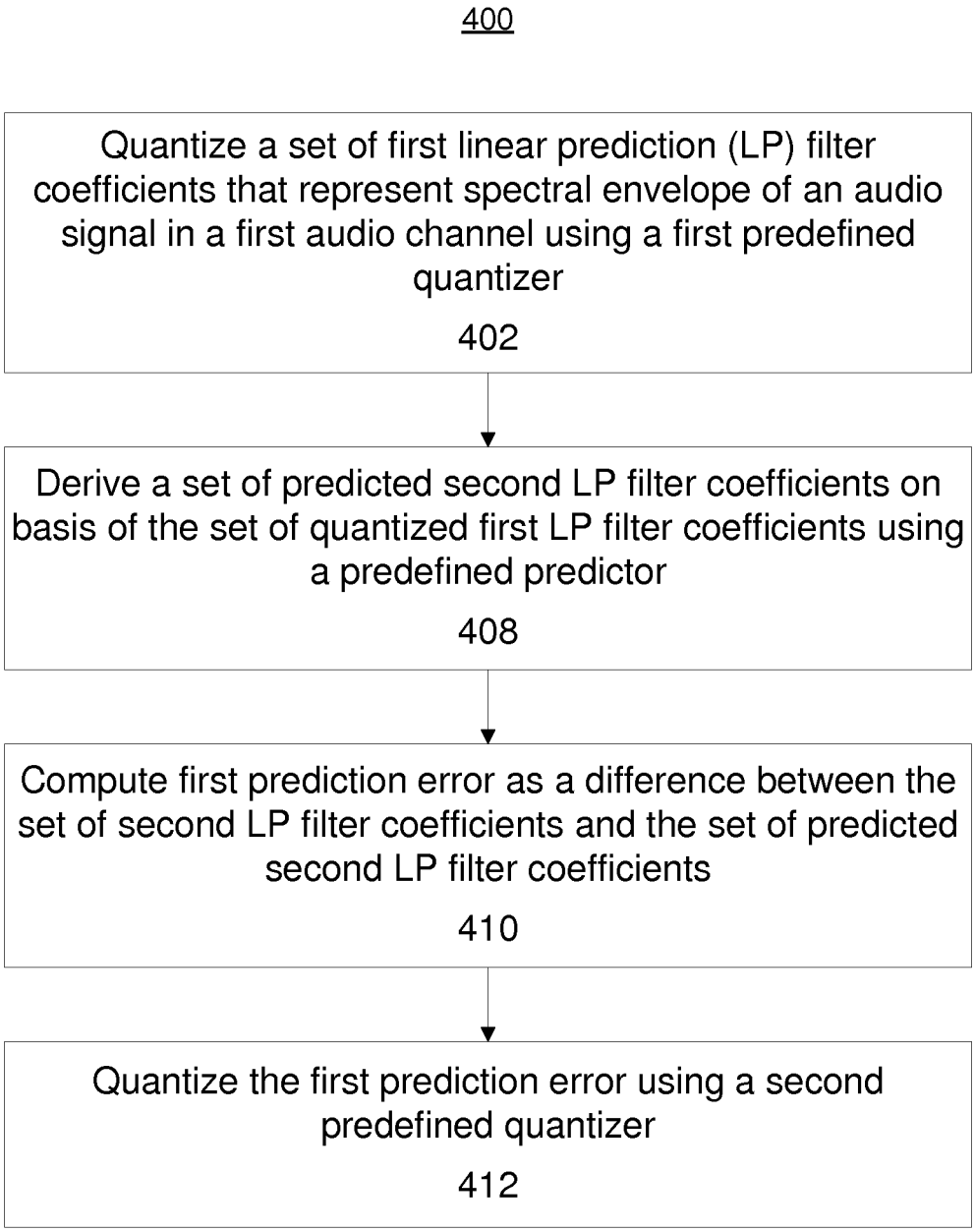
FIG. 4 illustrates a method according to an example.

An example of LP quantization procedure by the LP quantizer 332 is illustrated by the flowchart of FIG. 4, which represents steps of a method 400 for quantizing the first LP filter coefficients $a_{1,i}$ and the second LP filter coefficients $a_{2,i}$. The LP quantization procedure according to this example commences from quantizing the set of first LP filter coefficients $a_{1,i}$ by using a (first) predefined quantizer, as indicated in block 402. This quantizer may be referred to as a first-channel quantizer. In an example, quantization of the first LP filter coefficients $a_{1,i}$ involves converting the first LP filter coefficients $a_{1,i}$ into first line spectral frequencies (LSFs), denoted herein as $f_{1,i}$, i=0:M−1. The LSF representation of the LP filter coefficients is known in the art and any LP to LSF conversion technique known in the art is applicable in this regard.

The first-channel quantizer for quantizing the first LSFs $f_{1,i}$ may comprise any suitable quantizer, e.g. a non-predictive or a predictive vector quantizer designed to quantize a vector of mean-removed LSFs $f'_{1,i}$, i=0:M−1, where the vector of mean-removed LSFs $f'_{1,i}$ may be obtained, for example, by arranging the first LSFs $f_{1,i}$ into a vector and subtracting a vector of predefined mean LSF values $f_{M,i}$, i=0:M−1 therefrom. In case of predictive quantization, the prediction may involve a prediction based on one or more past values of quantized LP filter coefficients derived for the same channel and the prediction may be carried out by using a moving-average (MA) predictive vector quantizer that operates to quantize MA prediction error vector or an autoregressive (AR) predictive vector quantizer that operates to quantize AR prediction error vector. Such predictive quantizers are known in the art and are commonly applied in quantization of spectral parameters such as LSFs in context of speech and/or audio coding.

Regardless of the details of the quantization technique applied for the first LSFs $f_{1,i}$, the quantization results in deriving quantized first LSFs $\hat{f}_{1,i}$, i=0:M−1 and providing one or more quantization codewords that serve as encoded quantized first LP filter coefficients. The LP quantizer 332 further converts the quantized first LSFs $\tilde{f}_{1,i}$ into LP filter coefficient representation, thereby obtaining quantized first LP filter coefficients $\tilde{a}_{1,i}$ for provision to the first LP analysis filter 334-1 to enable LP analysis filtering therein.

The method 400 proceeds to quantizing the set of second LP filter coefficients $a_{2,i}$ on basis of the quantized first LP filter coefficients. In this regard, the method 400 comprises deriving predicted second LP filter coefficients on basis of the quantized first LP filter coefficients by using a (first) predefined predictor, as indicated in block 408. This predictor may be referred to as a first-to-second-channel predictor. Since the respective signals in first channel 223-1 and the second channel 223-2 are derived on basis of channels of the same input audio signal 115 (that may comprise a stereo audio signal), it is likely that they exhibit spectral similarity to some extent, thereby making the (quantized) first LP filter coefficients that represent spectral envelope of the first channel 223-1 signal to serve as a reasonable basis for estimating the second LP coefficients that represent spectral envelope of the second channel 223-1 signal.

In an example, derivation of the predicted second LP filter coefficients (block 408) using the first-to-second-channel predictor involves employing a predefined predictor matrix P to compute predicted second LSFs $\hat{f}_{2,i}$, i=0:M−1 on basis of the quantized first LSFs $\tilde{f}_{1,i}$, e.g. by $$\hat{f}_2=P\tilde{f}_1, \tag{2}$$

where $\hat{f}_2$ denotes the predicted second LSFs $\hat{f}_{2,i}$, i=0:M−1 arranged into a M-dimensional vector, $\tilde{f}_1$ denotes the quantized first LSFs $\tilde{f}_{1,i}$, i=0:M−1 arranged into a M-dimensional vector, and the predefined predictor matrix P is a M×M matrix of predictor coefficients $p_{i,j}$. Examples of applicable prediction matrices P are described in the following.

The method 400 proceeds to computing a first-to-second-channel prediction error $e_{1,i}$, i=0:M−1 as a difference between the set of second LP filter coefficients $a_{2,i}$ and the predicted second LP filter coefficients, as indicated in block 410. In the following, the first-to-second-channel prediction error $e_{1,i}$ is referred simply to as a first prediction error for brevity and editorial clarity of the description. In an example, this computation involves converting the set of second LP filter coefficients $a_{2,i}$ into second LSFs, denoted herein as $f_{2,i}$, i=0:M−1 and computing the first prediction error $e_{1,i}$, i=0:M−1 by $$e=f_2-\hat{f}_2=f_2-P\tilde{f}_1, \tag{3}$$

where e denotes the first prediction error $e_{1,i}$, i=0:M−1 arranged into a M-dimensional vector, and where $f_2$ denotes the second LSFs $f_{2,i}$, i=0:M−1 arranged into a M-dimensional vector.

The method 400 further proceeds to quantizing the first prediction error $e_{1,i}$, i=0:M−1 (i.e. the) by using the (second) predefined quantizer, as indicated in block 412, thereby obtaining quantized first prediction error $\tilde{e}_{1,i}$, i=0:M−1. The (second) predefined quantizer may be referred to as a first-to-second-channel quantizer. The LP quantizer 332 obtains the quantized second LSFs $\tilde{f}_{2,i}$, i=0:M−1 as a combination (e.g. a sum) of the predicted second LSFs $\hat{f}_{2,i}$, i=0:M−1 and the quantized first prediction error $\tilde{e}_{1,i}$, i=0:M−1, e.g. by $$\tilde{f}_2=\hat{f}_2+e \tag{4}$$

where $\tilde{f}_2$ denotes the quantized second LSFs $f_{2,i}$, i=0:M−1 arranged into an M-dimensional vector.

The LP quantizer 332 further converts the quantized second LSFs $\tilde{f}_{2,i}$ i=0:M−1 into LP filter coefficient representation, thereby obtaining quantized second LP filter coefficients $\tilde{a}_{2,i}$ for provision to the second LP analysis filter 334-2 to enable LP analysis filtering therein.

The LP quantizer 332 further encodes the quantized first prediction error $\tilde{e}_{1,i}$, i=0:M−1 and provides information (e.g. one or more codewords) that identifies the encoded first prediction error to the bitstream formatter 229 as part of the encoded LPC parameters for inclusion in the encoded audio signal 125. The quantization of the first prediction error $e_{1,i}$, i=0:M−1 may be carried out using any suitable vector quantizer known in the art, for example a multi-stage vector quantizer (MSVQ) or a multi-stage lattice vector quantizer (MSLVQ). Regardless of the details of the quantization technique applied for quantization the first prediction error $e_{1,i}$, i=0:M−1, the quantization results in deriving one or more codewords that serve to represent the encoded quantized second LP filter coefficients $\tilde{a}_{2,i}$.

Figure 5:
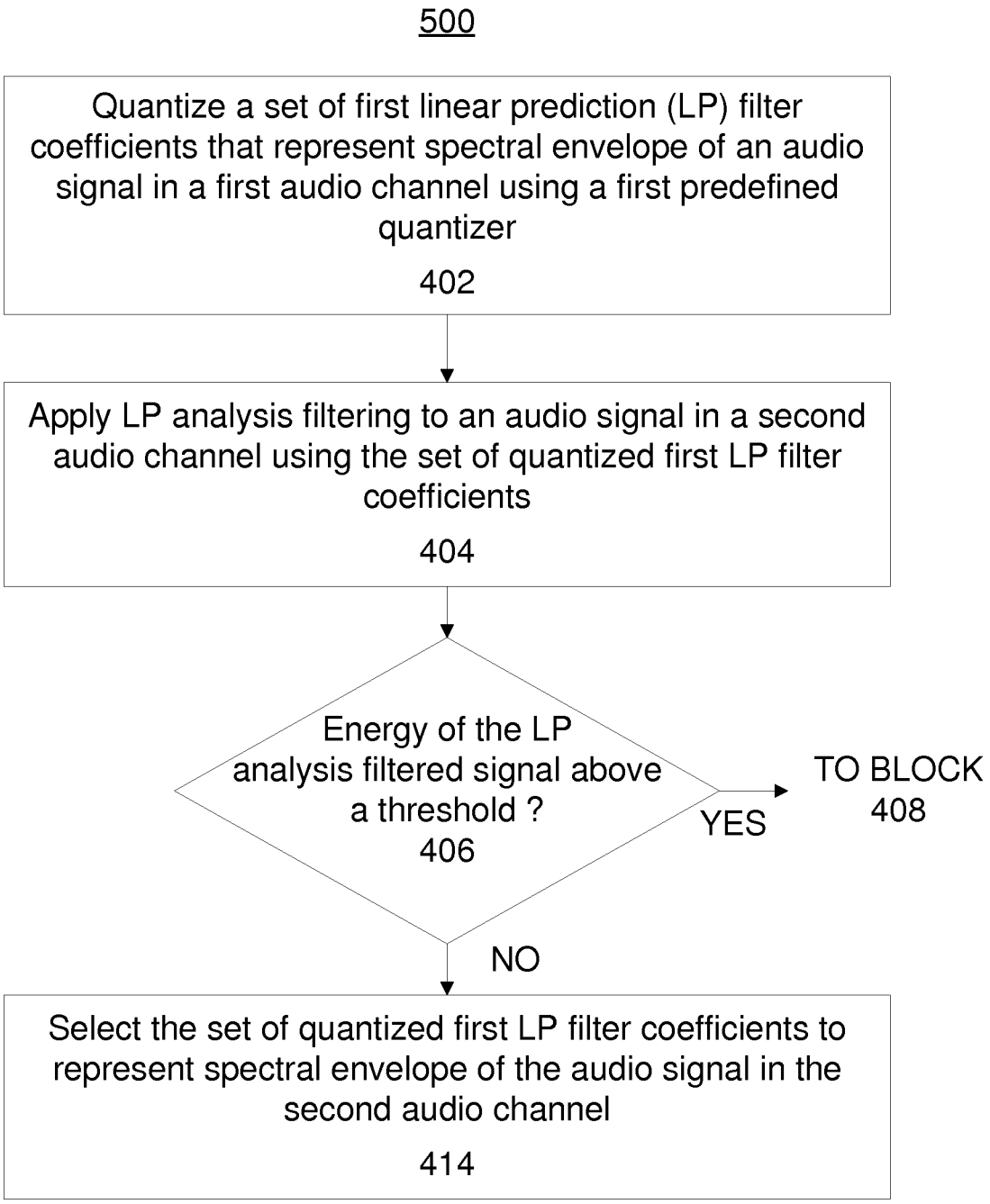
FIG. 5 illustrates a method according to an example.

Another example of LP quantization procedure by the LP quantizer 332 is illustrated by the flowchart of FIG. 5, which represents steps of a method 500 for quantizing the first LP filter coefficients $a_{1,i}$ and the second LP filter coefficients $a_{2,i}$. The LP quantization procedure according to this example commences from quantizing the set of first LP filter coefficients $a_{1,i}$ by using the (first) predefined quantizer, as indicated in block 402 and described in the foregoing in context of the method 400.

The method 500 proceeds to applying LP analysis filtering of a frame of the second channel 223-2 using the quantized first LP filter coefficients $\tilde{a}_{1,i}$, as indicated in block 404. Since the first channel 223-1 and the second channel 223-2 are derived on basis of the same audio input signal 115, it is likely that they exhibit spectral similarity to some extent, thereby making the quantized first LP coefficients that represent spectral envelope of the first channel 223-1 signal to provide a reasonable estimate of the second LP coefficients that represent spectral envelope of the second channel 223-1 signal.

The LP analysis filtering of block 404 may be provided, for example, according to the following equation:

$$r(t)=\Sigma_{i=0}^{M}\tilde{a}_{1,i}x_2(t-i),t=t+1:t+L, \tag{5}$$

where $\tilde{a}_{1,i}$, i=0:M, $\tilde{a}_{1,0}$=1 denote the quantized first LP filter coefficients, L denotes the frame length (in number of samples), $x_2(t)$, t=t+1:t+L denotes a frame of the signal in the second channel 223-2 (i.e. a time series of second channel samples), and r(t), t=t+1:t+L denotes the resulting residual signal.

If the evaluation in block 406 indicates that the energy of the residual signal r(t) is above a predefined threshold, the quantized first LP filter coefficients $\tilde{a}_{1,i}$ are considered as a poor match with the signal in the second channel 223-2 and the method 500 proceeds to carrying out operations pertaining to blocks 408 to 412 described in the foregoing. In contrast, in case the energy of the residual signal r(t) is not above the predefined threshold, the first LP filter coefficients $\tilde{a}_{1,i}$ are considered as a sufficient match with the signal in the second channel 223-2 and they are chosen to serve as the quantized second LP filter coefficients $\tilde{a}_{2,i}$ as well, as indicated in block 416.

In an exemplifying variation of the method 500, the evaluation of block 406 involves comparison of the energy of the frame of signal in the second channel 223-2 and a second threshold: if the energy is above the second threshold, the spectral envelope of the signal in the second channel 223-1 is considered to convey significant amount of information and this variant of the method 500 proceeds to carrying out operations pertaining to blocks 408 to 414 described in the foregoing. In contrast, in case the energy is not above the second threshold, the spectral envelope of the signal in the second channel 223-1 is considered to convey less than significant amount of information and the first LP filter coefficients $\tilde{a}_{1,i}$ are assumed as a sufficient match for the second channel 223-2 and they are chosen to serve as the quantized second LP filter coefficients $\tilde{a}_{2,i}$ as well (block 416).

In another exemplifying variation of the method 500, the evaluation of block 406 involves comparison of the difference between energy of the frame of signal in the second channel 223-2 and the energy of the energy of the residual signal r(t) to a third threshold: if the difference is above the third threshold, the first LP filter coefficients $\tilde{a}_{1,i}$ are considered as a sufficient match with the signal in the second channel 223-2 and they are chosen to serve as the quantized second LP filter coefficients $\tilde{a}_{2,i}$ as well (block 416), whereas in case the difference is not above the third threshold, the quantized first LP filter coefficients $\tilde{a}_{1,i}$ are considered as a poor match with the signal in the second channel 223-2 and the method 500 proceeds to carrying out operations pertaining to blocks 408 to 414 described in the foregoing.

In case the first LP filter coefficients $\tilde{a}_{1,i}$ are chosen to serve also as the quantized second LP filter coefficients $\tilde{a}_{2,i}$, the residual signal r(t) that may be derived for the evaluation of block 406 of the method 500 described may be employed as the second residual signal 225-2 for the current frame (i.e. a time series of second residual samples).

Figure 6:
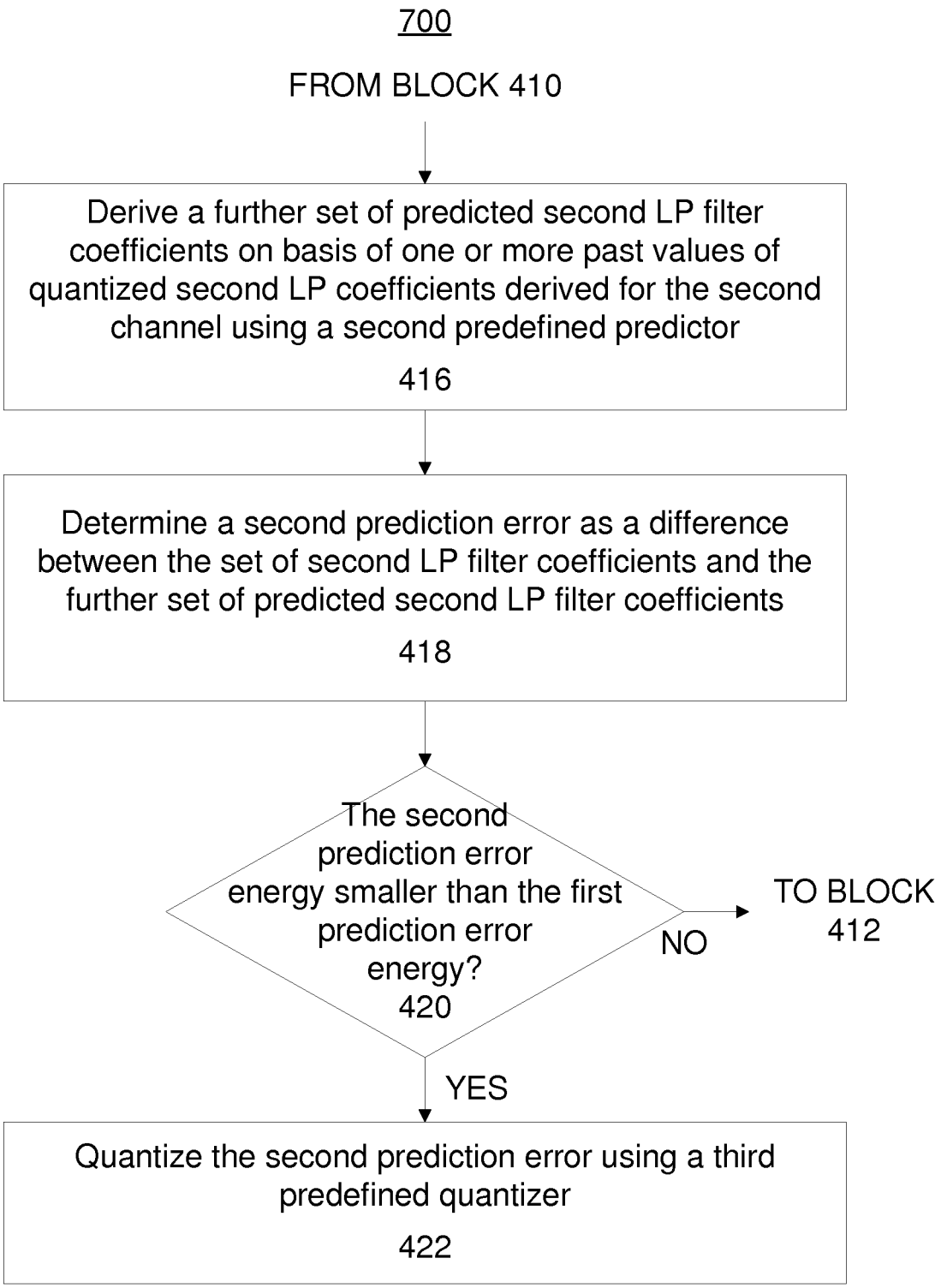
FIG. 6 illustrates a method according to an example.

Another example of LP quantization procedure by the LP quantizer 332 is illustrated by the flowchart of FIG. 6, which represents steps of a method 700 for quantizing the first LP filter coefficients $a_{1,i}$ and the second LP filter coefficients $a_{2,i}$. The LP quantization procedure according to the method 700 builds on the LP quantization by the method 400 to provide a switched-mode quantization. In this regard, in addition to blocks 402 to 410 of the method 400, the method 700 further involves quantizing the set of second LP filter coefficients $a_{2,i}$ by using a (third) predefined quantizer, which may comprise any suitable predictive quantizer that bases the prediction on one or more past values of quantized LP filter coefficients derived for the same channel (in this case the second channel 223-2), e.g. a MA predictive vector quantizer or an AR predictive vector quantizer referred to in the foregoing in context of the (first) predefined quantizer (block 402). The (third) predefined quantizer may be referred to as a second-channel quantizer.

In this regard, the method 700 comprises deriving further predicted second LP filter coefficients on basis of one or more past values of the second LP filter coefficients derived for the second channel 223-2 by using a (second) predefined predictor, as indicated in block 416. The (second) predefined predictor may be referred to as a second-channel predictor and it may be operated as part of the second-channel quantizer. The method 700 further comprises determining a second-channel prediction error $e_{2,i}$, i=0:M−1 as a difference between the set of second LP filter coefficients $a_{2,i}$ and the further predicted second LP filter coefficients, as indicated in block 418. In the following, the second-channel prediction error $e_{2,i}$ is referred simply to as a second prediction error for brevity and editorial clarity of the description The method 700 proceeds to compare energy of the second prediction error $e_{2,i}$, i=0:M−1 to energy of the first prediction error $e_{1,i}$, i=0:M−1 (block 420): in case the energy of the second prediction error is smaller than that of the first prediction error, the method 700 proceeds to quantizing the second prediction error $e_{2,i}$, i=0:M−1 (block 422) and using (and encoding) the quantized second prediction error to represent the quantized second LP filter coefficients $\tilde{a}_{2,i}$, whereas in case the energy of the second prediction error is not smaller than that of the first prediction error, the method 700 proceeds to quantizing the first prediction error $e_{1,i}$, i=0:M−1 (block 414) and using (and encoding) the quantized first prediction error to represent the quantized second LP filter coefficients $\tilde{a}_{2,i}$. In addition to information that serves as the encoded quantized first or second prediction error, also an indication of selected one of the first and second prediction errors is provided to the bitstream formatter 229 as part of the encoded LPC parameters for inclusion in the encoded audio signal 125 to enable reconstruction of the quantized second LP filter coefficients $\tilde{a}_{2,i}$ therein.

As an example of operations of blocks 416 to 422, the second predicted second LP filter coefficients may be provided as further predicted second LSFs $\hat{f}_{2,i}$, i=0:M−1, predicted on basis of the quantized second LSFs $\tilde{f}_{2,i}$, i=0:M−1 derived for one or more past frames (e.g. the most recent previous frames) in the second channel 223-2 (block 416), whereas second prediction error may be derived as the difference between the second LSFs $f_{2,i}$, i=0:M−1 and the further predicted second LSFs $\hat{f}_{2,i}$, i=0:M−1 (block 418).

The predictor matrix P may be derived on basis of a training database that includes a collection of first channel LSFs and second channel LSFs. The first and second channel LSFs for the training database may be computed, for example, by processing desired audio signals as the input audio signals 115, frame by frame, through the channel decomposer 222 and the first and second LP analyzers 331-1, 331-2 to obtain a respective pairs of the first and second LSFs for each processed frame, thereby arriving at the collection of first channel LSFs and second channel LSFs that serves as the training database. In this regard, the collection of first channel LSFs may be provided as a matrix $\Omega_1$, where the first channel LSFs are arranged as vectors that are provided as columns of the matrix $\Omega_1$ and the corresponding collection of second channel LSFs may be provided as a matrix $\Omega_2$, where the second channel LSFs are arranged as vectors that are provided as columns of the matrix $\Omega_2$.

In an example, the predictor matrix P may be provided as M×M matrix $P_M$ derived as $P_M=\Omega_2\Omega_1^{-1}$, where $\Omega_1^{-1}$ denotes the pseudo-inverse of $\Omega_1$, thereby arriving at the matrix $P_M$ with M×M non-zero predictor coefficients $p_{i,j}$.

In another example, the predictor matrix P may be provided as a tri-diagonal M×M matrix $P_3$ that has non-zero elements only in its main diagonal, in the first diagonal below the main diagonal and in the first diagonal above the main diagonal. In such a matrix the rows and columns apart from the first and last one include only three non-zero elements, while the first and last columns include only two non-zero element. Hence, using the tri-diagonal matrix $P_3$ instead of the matrix $P_M$ as the predictor matrix P enables savings in data storage requirements since only the non-zero predictor coefficients $p_{i,j}$ (with $|i-j|\leq 1$) need to be stored, while the prediction performance is still sufficient. The tri-diagonal matrix $P_3$ may be derived on basis of the training database provided in $\Omega_1$ and $\Omega_2$ as described in the following.

The non-zero predictor coefficients $p_{i,j}$ for the j:th row of the tri-diagonal matrix $P_3$ may be solved from the following equation:

$$\begin{bmatrix} X_{j-1}^2 & X_{j-1}X_j & X_{j-1}X_{j+1} \\ X_{j-1}X_j & X_j^2 & X_jX_{j+1} \\ X_{j-1}X_{j+1} & X_jX_{j+1} & X_{j+1}^2 \end{bmatrix} \begin{bmatrix} p_{j,j-1} \\ p_{j,j} \\ p_{j,j+1} \end{bmatrix} = \begin{bmatrix} X_{j-1}Y_j \\ X_jY_j \\ X_{j+1}Y_j \end{bmatrix} \quad (6)$$

where $$X_j^2=\Sigma_{i=1}^{N}\Omega_{1j,i}$$

$$X_{j-1}X_j=\Sigma_{i=1}^{N}\Omega_{1j-1,i}\Omega_{1j,i}$$

$$X_{j-1}Y_j=\Sigma_{i=1}^{N}\Omega_{1j-1,i}\Omega_{2j,i} \quad (7)$$

where N denotes the number of pairs of the first and second LSFs in the matrices $\Omega_1$ and $\Omega_2$ that represent the training database.

In a further example, the predictor matrix P may be provided as a diagonal M×M matrix $P_1$, i.e. as a matrix where only elements of the main diagonal are non-zero. Hence, using the diagonal matrix $P_1$ as the predictor matrix P enables further savings in data storage requirements since only the non-zero predictor coefficients $p_{i,j}$ (with i=j) need to be stored, while this may result in a minor decrease in prediction performance. The non-zero predictor coefficients $p_{i,j}$ for the diagonal matrix $P_1$ may be derived on basis of the training database provided in $\Omega_1$ and $\Omega_2$ e.g. according to the following equation:

$$p_{i,j} = \frac{X_j Y_j}{X_j^2}, \quad (8)$$

where the terms $X_jY_j$ and $X_j^2$ are defined in the foregoing in context of definition of the tri-diagonal matrix $P_3$.

In a yet further example, the predictor matrix P may be provided as a M×M matrix $P_2$, where only two non-zero elements are provided in each row of the matrix. Such matrix may be referred to as a sparse tri-diagonal matrix. Hence, using the matrix $P_2$ as the predictor matrix P enables both storage requirements and prediction performance that are between those provided by usage of the tri-diagonal matrix $P_3$ or the diagonal matrix $P_1$ as the predictor matrix P. The non-zero predictor coefficients $p_{i,j}$ for the matrix $P_2$ may be derived on basis of the training database provided in $\Omega_1$ and $\Omega_2$ e.g. by first deriving the tri-diagonal matrix $P_3$ using the equations (6) and (7) and selecting for each row j of the resulting tri-diagonal matrix $P_3$ the position of the diagonal element $p_{j,j}$ and the position of the larger one of the elements $p_{j,j-1}$ and $p_{j,j+1}$. Once having selected, the non-zero predictor coefficients for the matrix $P_2$ may be derived using the equations (6) and (7) with the following modification: when deriving the non-zero predictor coefficients for the j:th row:

- if the position of $p_{j,j-1}$ was selected for the j:th row, in the equation (6) only the 2×2 submatrix in the upper left corner together with the two first elements of the vectors are considered;
- if the position of $p_{j,j+1}$ was selected for the j:th row, in the equation (6) only the 2×2 submatrix in the lower right corner together with the two last elements of the vectors are considered.

As a further example concerning the predictor matrix P, the following table provides an example of non-zero predictor coefficients $p_{j,j-1}$, $p_{j,j}$ and $p_{j,j+1}$ within a tri-diagonal matrix $P_3$ with M=16:

| Row (j) | $P_{j,j-1}$ | $P_{j,j}$ | $P_{j,j+1}$ |
|---|---|---|---|
| 1 | — | 0.46424 | 0.44424 |
| 2 | 0.06391, | 0.70645 | 0.27746 |
| 3 | 0.19823 | 0.45790 | 0.35297 |
| 4 | −0.14311 | 0.72340 | 0.32507 |

-continued

| Row (j) | $P_{j,j-1}$ | $P_{j,j}$ | $P_{j,j+1}$ |
|---|---|---|---|
| 5 | −0.00288 | 0.75421 | 0.22476 |
| 6 | 0.04188f | 0.54749 | 0.36915 |
| 7 | 0.04033 | 0.79567 | 0.15806 |
| 8 | 0.27401 | 0.52526 | 0.21235 |
| 9 | 0.08720 | 0.52943 | 0.36251 |
| 10 | 0.04151 | 0.71651 | 0.22864 |
| 11 | 0.12752 | 0.66654 | 0.20319 |
| 12 | 0.20339 | 0.56061 | 0.23328 |
| 13 | 0.12102 | 0.57411 | 0.29234 |
| 14 | 0.10202 | 0.67330 | 0.21383 |
| 15 | 0.17973 | 0.59564 | 0.21825 |
| 16 | 0.16594 | 0.83547 | — |

The LP quantizer 332 provides the quantized first and second LP filter coefficients $\tilde{a}_{1,i}$, $\tilde{a}_{2,i}$ to a first LP analysis filter 334-1 and to a second LP analysis filter, respectively. The first LP analysis filter 334-1 employs the quantized first LP filter coefficients $\tilde{a}_{1,i}$ to process a frame of the first channel 223-1 into a corresponding frame of the first residual signal 225-1, e.g. according to the following equation:

$$r_1(t)=\Sigma_{i=0}^{M}\tilde{a}_{1,i}x_1(t-i), t=t+1:t+L, \quad (9)$$

where $\tilde{a}_{1,i}$, i=0:M, $\tilde{a}_{1,0}$=1 denote the quantized first LP filter coefficients, L denotes the frame length (in number of samples), $x_1(t)$, t=t+1:t+L denotes a frame of the signal in the first channel 223-1 (i.e. a time series of first channel samples), and $r_1(t)$, t=t+1:t+L denotes a corresponding frame of the first residual signal 225-1 (i.e. a time series of first residual samples).

The second LP analysis filter 334-2 employs the quantized second LP filter coefficients $\tilde{a}_{2,i}$ to process a frame of the second channel 223-2 into a corresponding frame of the second residual signal 225-2, e.g. according to the following equation:

$$r_2(t)=\Sigma_{i=0}^{M}\tilde{a}_{2,i}x_2(t-i), t=t+1:t+L, \quad (10)$$

where $\tilde{a}_{2,i}$, i=0:M, $\tilde{a}_{2,0}$=1 denote the quantized second LP filter coefficients, $x_2(t)$, t=t+1:t+L denotes a frame of the signal in the second channel 223-2 (i.e. a time series of second channel samples), and $r_2(t)$, t=t+1:t+L denotes a corresponding frame of the second residual signal 225-2 (i.e. a time series of second residual samples).

The first residual encoder 228-1 operates to process a frame of the first residual signal 225-1 to derive and encode one or more first residual parameters that are descriptive of the frame of the first residual signal 225-1. Residual encoding in the first residual encoder 228-1 may involve a suitable residual encoding technique or a combination of two or more residual encoding techniques known in the art. As a non-limiting example in this regard, the residual encoding may comprise long-term predictive (LTP) encoding to process the frame of the first residual signal 225-1 to extract one or more first LTP parameters (e.g. a LTP lag and a LTP gain) and use the extracted first LTP parameters to reduce the frame of the first residual signal 225-1 into a corresponding frame of an intermediate residual signal, which is further subjected to an excitation coding e.g. according to the algebraic code excited linear prediction (ACELP) model to derive one or more first excitation parameters. The first residual encoder 228-1 further encodes the first LTP parameters and the first excitation parameters and provides the encoded first LTP parameters and excitation parameters as the encoded first residual parameters to the bitstream formatter 229 for inclusion in the encoded audio signal 125, thereby providing information that is useable in the audio decoder to reconstruct the first residual signal 225-1 for use as an excitation signal for LP synthesis filtering therein.

Along similar lines, the second residual encoder 228-2 operates to process a frame of the second residual signal 225-2 to derive and encode one or more second residual signal parameters that are descriptive of the frame of the second residual signal 225-2. Residual encoding in the second residual encoder 228-2 may involve a suitable residual encoding technique or a combination of two or more residual encoding techniques known in the art. As a non-limiting example in this regard, the residual encoding may comprise LTP encoding to process the frame of the second residual signal 225-2 to extract one or more second LTP parameters (e.g. a LTP lag and a LTP gain) and use the extracted second LTP parameters to reduce the frame of the second residual signal 225-2 into a corresponding frame of an intermediate residual signal, which is further subjected to an excitation coding e.g. according to the ACELP model to derive one or more second excitation parameters. The second residual encoder 228-2 further encodes the second LTP parameters and the second excitation parameters and provides the encoded second LTP parameters and excitation parameters as the encoded second residual parameters to the bitstream formatter 229 for inclusion in the encoded audio signal 125, thereby providing information that is useable in the audio decoder to reconstruct the second residual signal 225-2 for use as an excitation signal for LP synthesis filtering therein.

The bitstream formatter 229 receives the encoded LPC parameters from the LCP encoder 224, the encoded first residual parameters from the first residual encoder 228-1 and the encoded second residual parameters from second residual encoder 228-2 for each processed frame of the input audio signal 115 and arranges these encoded parameters into one or more PDUs for transfer to the decoding entity 130 over a network/channel, whereas the audio decoding entity 130 may further comprise.

Figure 7:
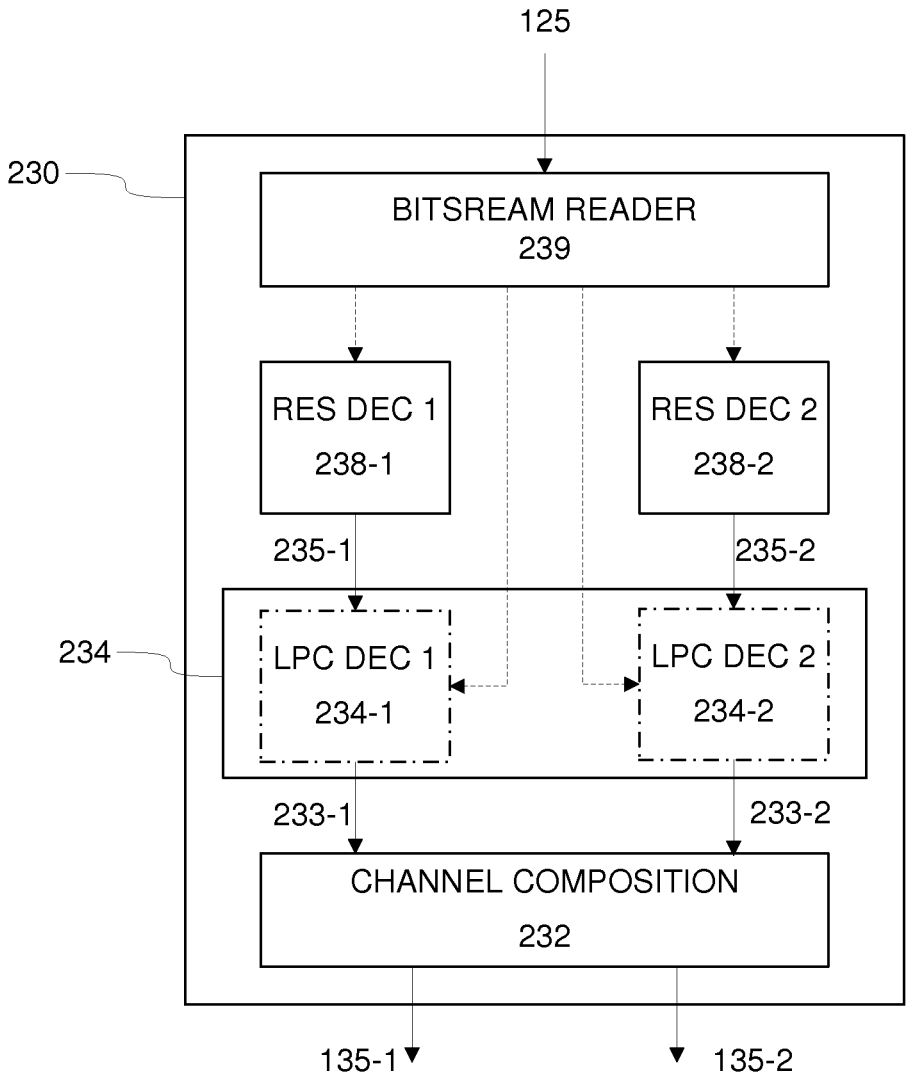
FIG. 7 illustrates a block diagram of some components and/or entities of an audio decoder according to an example.

In the following, some aspects of a LPC decoding and a LP parameter dequantization technique are described in a framework of an exemplifying audio decoder 230. In this regard, FIG. 7 illustrates a block diagram of some components and/or entities of the audio decoder 320. The audio decoder 320 may be provided, for example, as the audio encoding entity 130 or as a part thereof.

The audio decoder 230 carries out decoding of the encoded audio signal 125 into the reconstructed audio signal 135. In other words, the audio decoder 230 implements a transform from the encoded domain to the signal domain (e.g. time domain) and it processes the encoded audio signal 125 received as a sequence of encoded frames, each encoded frame representing a segment of audio signal to be decoded into a reconstructed left channel signal 135-1 and a reconstructed right channel signal 135-2 that constitute the reconstructed audio signal 135.

A bitstream reader 239 extracts, from the one or more PDUs that carry encoded parameters for a frame, the encoded first residual parameters, the encoded second residual parameters and the encoded LPC parameters and provides them for a first residual decoder 238-1, a second residual decoder 238-2 and a LPC decoder 234, respectively.

The first residual decoder 238-1 carries out residual decoding to generate a frame of reconstructed first residual signal 235-1 on basis of the encoded first residual parameters. As a non-limiting example, the residual decoding in the first residual decoder 238-1 may involve deriving a first component of the reconstructed first residual signal on basis of one or more first excitation parameters received in the encoded first residual parameters (e.g. according to the ACELP model), deriving a second component of the reconstructed first residual signal on basis of the first LTP parameters received in the encoded first residual parameters (e.g. the LTP lag and the LTP gain) and deriving the frame of the reconstructed first residual signal 235-1 as a combination of the first and second components.

Along similar lines, the second residual decoder 238-2 carries out residual decoding to generate a frame of reconstructed second residual signal 235-2 on basis of the encoded second residual parameters. As a non-limiting example, the residual decoding in the second residual decoder 238-2 may involve deriving a first component of the reconstructed second residual signal on basis of one or more second excitation parameters received in the encoded second residual parameters (e.g. according to the ACELP model), deriving a second component of the reconstructed second residual signal on basis of the second LTP parameters received in the encoded second residual parameters (e.g. the LTP lag and the LTP gain) and deriving the frame of the reconstructed second residual signal 235-2 as a combination of the first and second components.

The LPC decoder 234 serves to generate a first channel signal 233-1 on basis of the reconstructed first residual signal 235-1 and to generate a second channel signal 233-2 on basis of the reconstructed second residual signal 235-2. The LPC decoder 234 comprises, at least conceptually, a first LPC decoder 234-1 and a second LPC decoder 234-2.

The LPC decoder 234, e.g. the first LPC decoder 234-1, carries out an LPC decoding procedure to process a frame of the reconstructed first residual signal 235-1 into a corresponding frame of a reconstructed first channel signal 233-1. The LPC decoding procedure by the first LPC decoder 234-1 may involve reconstructing the quantized first LP filter coefficients and applying of the reconstructed quantized first LP filter coefficients to carry out LP synthesis filtering to derive the frame of reconstructed first channel signal 233-1 on basis of the frame of the reconstructed first residual signal 235-1. The LPC decoder 234 further provides the frame of the reconstructed first channel signal 233-1 for a channel composer 232 for derivation of the reconstructed audio signal 135 therein.

The LPC decoder 234, e.g. the second LPC decoder 234-2, carries out an LPC decoding procedure to process a frame of the reconstructed second residual signal 235-2 into a corresponding frame of a reconstructed second channel signal 233-2. The LPC decoding procedure by the second LPC decoder 234-2 may involve reconstructing the quantized second LP filter coefficients and applying the reconstructed quantized second LP filter coefficients to carry out LP synthesis filtering to derive the frame of reconstructed second channel signal 233-3 on basis of the frame of the reconstructed second residual signal 235-2. The LPC decoder 234 further provides the frame of the reconstructed second channel signal 233-2 for the channel composer 232 for derivation of the reconstructed audio signal 135 therein.

Figure 8:
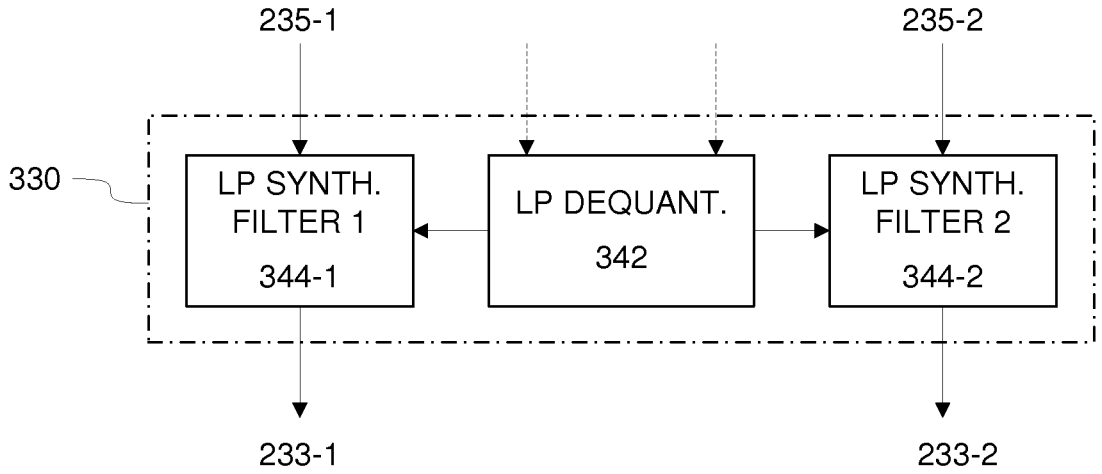
FIG. 8 illustrates a block diagram of some components and/or entities of a LPC decoder according to an example.

As an example of the LPC decoder 234, FIG. 8 illustrates a block diagram of some components and/or entities of a LPC decoder 330 that may be employed, for example, as the LPC decoder 234 or as a part thereof in the framework of FIG. 7.

In the LPC decoder 330, a LP dequantizer 342 operates to reconstruct the quantized first LP filter coefficients $\tilde{a}_{1,i}$ and the quantized second LP filter coefficients $\tilde{a}_{2,i}$ on basis of information received in the encoded LPC parameters. The quantized first LP filter coefficients $\tilde{a}_{1,i}$ are provided to a first LP synthesis filter 344-1, which employs the quantized first LP filter coefficients $\tilde{a}_{1,i}$ to process a frame of the reconstructed first residual signal 235-1 into a corresponding frame of the first channel signal 233-1, The quantized second LP filter coefficients $\tilde{a}_{2,i}$ are provided to a second LP synthesis filter 344-2, which employs the quantized second LP filter coefficients $\tilde{a}_{2,i}$ to process a frame of the reconstructed second residual signal 235-2 into a corresponding frame of the second channel signal 233-2, As an example, the LP dequantizer 342 operates to reconstruct the quantized first LP filter coefficients $\tilde{a}_{1,i}$ by reconstructing quantized first LSFs $\tilde{f}_{1,i}$, i=0:M−1 on basis of one or more quantization codewords received in the encoded LPC parameters. In this regard, the LP dequantizer 342 reverses the operation carried out by the LP quantizer 332. Along the line described for the LP quantizer 332, this operation may employ any suitable non-predictive or predictive quantizer. The LP dequantizer 342 may further convert the quantized first LSFs $\tilde{f}_{1,i}$ into LP filter coefficient representation, thereby obtaining quantized first LP filter coefficients for provision to the first LP synthesis filter 344-1 for the LP synthesis filtering therein.

Figure 9:
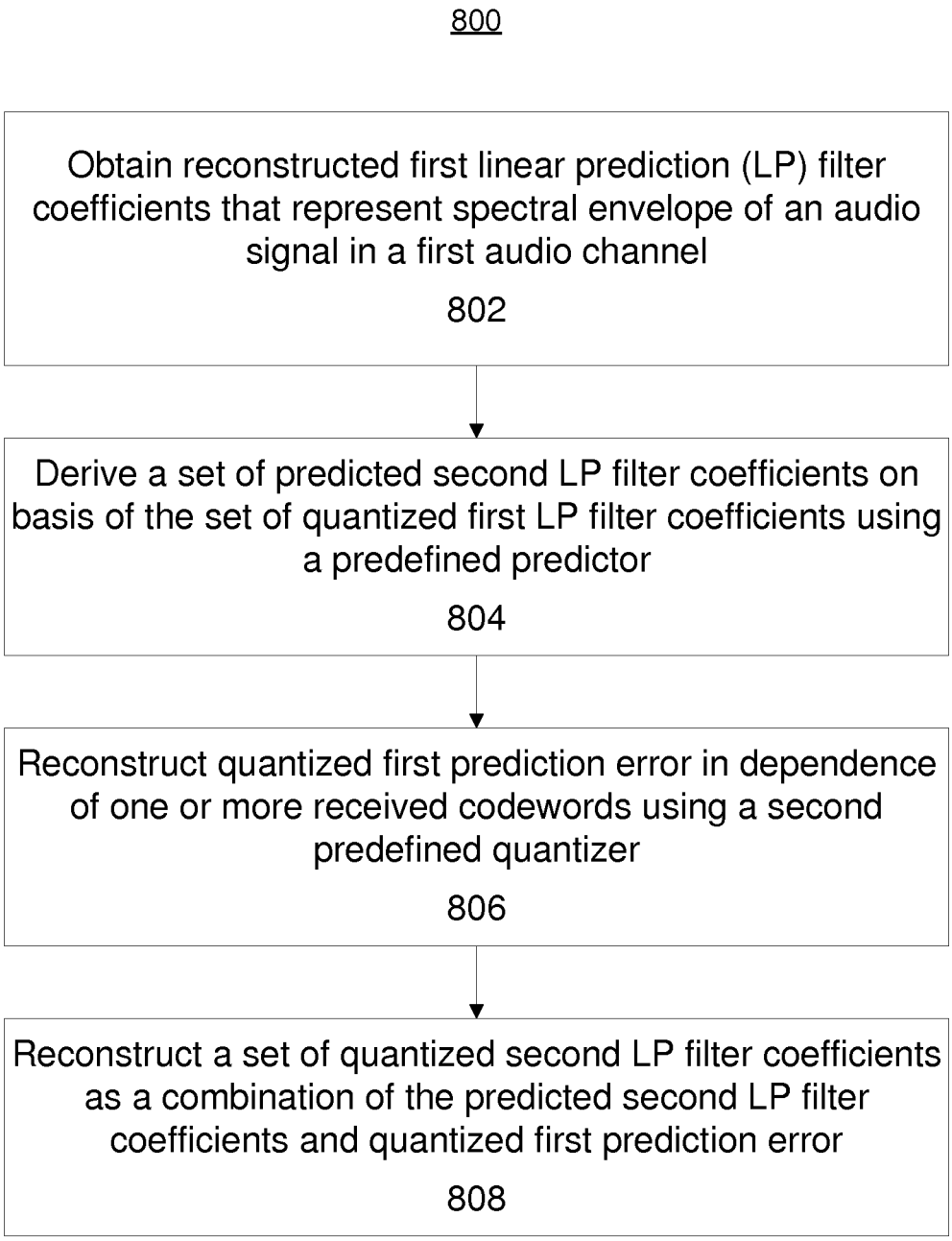
FIG. 9 illustrates a method according to an example.

The LP dequantizer 342 may further operate to reconstruct the quantized second LP filter coefficients in accordance with an exemplifying reconstruction procedure illustrated by the flowchart of FIG. 9, which represents steps of a method 800 for reconstructing the quantized second LP filter coefficients $\tilde{a}_{2,i}$ on basis of the reconstructed first quantized first LP filter coefficients $\tilde{a}_{1,i}$. The method 800 basically serves to reconstruct the quantized second LP filter coefficients $\tilde{a}_{2,i}$ based on encoded LPC parameters derived on basis the method 400 described in the foregoing. The method 800 is outlined in the following by using the LSF representation of the LP filter coefficients as a non-limiting example.

The method 800 proceeds from obtaining the quantized first LSFs $\tilde{f}_{2,i}$, i=0:M−1 that represent the spectral envelope of a frame of the first channel signal 233-1, as indicated in block 802. The method 800 continues to deriving the predicted second LSFs $\hat{f}_{2,i}$, i=0:M−1 on basis of the quantized first LSFs $\tilde{f}_{1,i}$, by using a predictor, as indicated in block 804. The predefined predictor is the same predictor as applied in the LP quantizer 332, and the operations pertaining to block 804 are similar to those described in context of block 408 in the foregoing.

The method 800 further comprises reconstructing the quantized first-to-second-channel prediction error $\tilde{e}_{1,i}$, i=0:M−1 (i.e. the first prediction error in short) by using the first-to-second-channel quantizer (described in the foregoing in context of block 412), as indicated in block 806. The reconstruction may be carried out in dependences of the information (e.g. one or more codewords) that identifies encoded first prediction error, received in the encoded LPC parameters. The method 800 further proceeds to reconstructing the quantized second LSFs $\tilde{f}_{2,i}$, i=0:M−1 as a combination (e.g. sum) of the predicted second LSFs $\hat{f}_{2,i}$, i=0:M−1 and the quantized first prediction error $\tilde{e}_{1,i}$, i=0:M−1, e.g. in accordance with the equation (4).

The LP dequantizer 342 further converts the quantized second LSFs $\tilde{f}_{2,i}$ i=0:M−1 into LP filter coefficient representation, thereby obtaining quantized second LP filter coefficients $\tilde{a}_{2,i}$ for provision to the second LP synthesis filter 344-2 for the LP synthesis filtering therein.

The first LP synthesis filter 344-1 receives the quantized first LP filter coefficients $\tilde{a}_{1,i}$ and employs them to process a frame of the reconstructed first residual signal 235-1 into a corresponding frame of the reconstructed first channel signal 233-1, e.g. according to the following equation:

$$\hat{x}_1(t)=\hat{r}_1(t)-\Sigma_{i=0}^{M}\tilde{a}_{1,i}\hat{x}_1(t-i),t=t+1:t+L, \tag{11}$$

where $\tilde{a}_{1,i}$, i=0:M, $\tilde{a}_{1,0}$=1 denote the quantized first LP filter coefficients, L denotes the frame length (in number of samples), $\hat{x}_1(t)$, t=t+1:t+L denotes a frame of reconstructed first channel signal 233-1 (i.e. a time series of reconstructed first channel samples), and $\hat{r}_1(t)$, t=t+1:t+L denotes a corresponding frame of the reconstructed first residual signal 235-1 (i.e. a time series of reconstructed first residual samples).

The second LP synthesis filter 344-2 receives the quantized second LP filter coefficients $\tilde{a}_{2,i}$ and employs them to process a frame of the reconstructed second residual signal 235-1 into a corresponding frame of the reconstructed first channel signal 233-1, e.g. according to the following equation:

$$\hat{x}_2(t)=\hat{r}_2(t)-\Sigma_{i=0}^{M}\tilde{a}_{2,i}\hat{x}_2(t-i),t=t+1:t\ L, \tag{12}$$

where $\tilde{a}_{2,i}$, i=0:M, $\acute{a}_{2,0}$=1 denote the quantized second LP filter coefficients, L denotes the frame length (in number of samples), $\hat{x}_2(t)$, t=t+1:t+L denotes a frame of reconstructed second channel signal 233-2 (i.e. a time series of reconstructed second channel samples), and $\hat{r}_2(t)$, t=t+1:t+L denotes a corresponding frame of the reconstructed second residual signal 235-2 (i.e. a time series of reconstructed second residual samples).

The channel composer 232 receives the reconstructed first channel signal 233-1 and the reconstructed second channel signal 233-2 and converts them into reconstructed left channel signal 135-1 and the reconstructed right channel signal 135-2 that constitute the reconstructed audio signal 135. In general, the channel composer 232 operates to invert the decomposition process provided in the channel decomposer 222. For example in case of the classic mid/side decomposition the reconstructed left channel signal 135-1 may be derived as the sum of the reconstructed first and second channel signals 233-1, 233-2 divided by two and the reconstructed right channel signal 135-2 may be derived as the difference of the first and second channel signals 233-1, 233-2 divided by two.

The description in the foregoing makes use of the LSF representation of the LP filter coefficients for quantization (e.g. block 402) and prediction (e.g. block 408). The LSF representation, however, serves as a non-limiting example and different representation of the LP filter coefficients may be employed instead. As an example in this regard, the methods 400, 500, 700 and 800 (and any variations thereof) may employ the immittance spectral frequency (ISF) representation of the LP filter coefficients instead, thereby operating the LP quantizer 332 to convert the first and second LP filter coefficients $a_{1,i}$, $a_{2,i}$ into respective first and second ISFs and to carry the quantization procedure on basis of the first and second ISFs.

The description in the foregoing makes use of a stereo audio signal as the input audio signal 115. However, this serves a non-limiting example and the audio processing system 100 and its components, including the audio encoder 220 and the audio decoder 230 may be arranged to process a multi-channel signal of more than two channels instead. As an example of such a scenario the channel decomposer 222 may receive channels 115-*j* of the input audio signal 115 and may derive the signal for the first channel 223-1 as a sum (or as an average or as a weighted sum) of signals across the input channels 115-*k* whereas the second channel may be derived as a difference between a pair of channels 115-*j* or as another linear combination of two or more channels 115-*j*.

Figure 10:
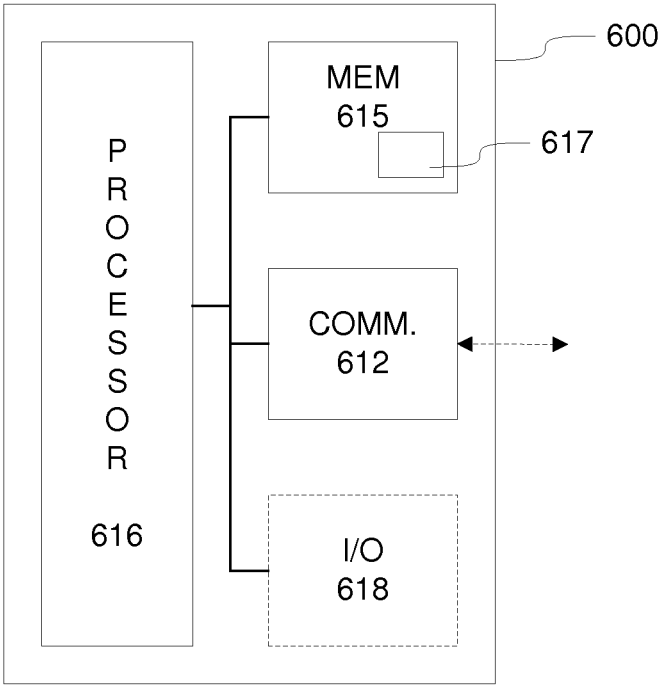
FIG. 10 illustrates a block diagram of some components and/or entities of an apparatus according to an example.

FIG. 10 illustrates a block diagram of some components of an exemplifying apparatus 600. The apparatus 600 may comprise further components, elements or portions that are not depicted in FIG. 10. The apparatus 600 may be employed e.g. in implementing the LPC encoder 320 or a component thereof (e.g. the LP quantizer 332), either as part of the audio encoder 220, as part of a different audio encoder or as an entity separate from an audio encoder or in implementing the LPC decoder 330 or a component thereof (e.g. the LP dequantizer 342), either as part of the audio decoder 230, as part of a different audio decoder or as an entity separate from an audio decoder.

The apparatus 600 comprises a processor 616 and a memory 615 for storing data and computer program code 617. The memory 615 and a portion of the computer program code 617 stored therein may be further arranged to, with the processor 616, to implement the function(s) described in the foregoing in context of the LPC encoder 320 (or a component thereof) and/or in context of the LPC decoder 330 (or a component thereof).

The apparatus 600 comprises a communication portion 612 for communication with other devices. The communication portion 612 comprises at least one communication apparatus that enables wired or wireless communication with other apparatuses. A communication apparatus of the communication portion 612 may also be referred to as a respective communication means.

The apparatus 600 may further comprise user I/O (input/output) components 618 that may be arranged, possibly together with the processor 616 and a portion of the computer program code 617, to provide a user interface for receiving input from a user of the apparatus 600 and/or providing output to the user of the apparatus 600 to control at least some aspects of operation of the LPC encoder 320 (or a component thereof) and/or LPC decoder 330 (or a component thereof) implemented by the apparatus 600. The user I/O components 618 may comprise hardware components such as a display, a touchscreen, a touchpad, a mouse, a keyboard, and/or an arrangement of one or more keys or buttons, etc. The user I/O components 618 may be also referred to as peripherals. The processor 616 may be arranged to control operation of the apparatus 600 e.g. in accordance with a portion of the computer program code 617 and possibly further in accordance with the user input received via the user I/O components 618 and/or in accordance with information received via the communication portion 612.

Although the processor 616 is depicted as a single component, it may be implemented as one or more separate processing components. Similarly, although the memory 615 is depicted as a single component, it may be implemented as one or more separate components, some or all of which may be integrated/removable and/or may provide permanent/semi-permanent/dynamic/cached storage.

The computer program code 617 stored in the memory 615, may comprise computer-executable instructions that control one or more aspects of operation of the apparatus 600 when loaded into the processor 616. As an example, the computer-executable instructions may be provided as one or more sequences of one or more instructions. The processor 616 is able to load and execute the computer program code 617 by reading the one or more sequences of one or more instructions included therein from the memory 615. The one or more sequences of one or more instructions may be configured to, when executed by the processor 616, cause the apparatus 600 to carry out operations, procedures and/or functions described in the foregoing in context of the LPC encoder 320 (or a component thereof) and/or in context of the LPC decoder 330 (or a component thereof).

Hence, the apparatus 600 may comprise at least one processor 616 and at least one memory 615 including the computer program code 617 for one or more programs, the at least one memory 615 and the computer program code 617 configured to, with the at least one processor 616, cause the apparatus 600 to perform operations, procedures and/or functions described in the foregoing in context of the LPC encoder 320 (or a component thereof) and/or in context of the LPC decoder 330 (or a component thereof).

The computer programs stored in the memory 615 may be provided e.g. as a respective computer program product comprising at least one computer-readable non-transitory medium having the computer program code 617 stored thereon, the computer program code, when executed by the apparatus 600, causes the apparatus 600 at least to perform operations, procedures and/or functions described in the foregoing in context of the LPC encoder 320 (or a component thereof) and/or in context of the LPC decoder 330 (or a component thereof). The computer-readable non-transitory medium may comprise a memory device or a record medium such as a CD-ROM, a DVD, a Blu-ray disc or another article of manufacture that tangibly embodies the computer program. As another example, the computer program may be provided as a signal configured to reliably transfer the computer program.

Reference(s) to a processor should not be understood to encompass only programmable processors, but also dedicated circuits such as field-programmable gate arrays (FPGA), application specific circuits (ASIC), signal processors, etc. Features described in the preceding description may be used in combinations other than the combinations explicitly described.

Although functions have been described with reference to certain features, those functions may be performable by other features whether described or not. Although features have been described with reference to certain embodiments, those features may also be present in other embodiments whether described or not.

The invention claimed is:

1. An apparatus comprising at least one processor; and at least one memory including computer program code, which when executed by the at least one processor, causes the apparatus to:

obtain a set of first linear prediction (LP) filter coefficients for an audio signal in a first channel derived from a multi-channel input audio signal;

obtain a set of second LP filter coefficients for an audio signal in a second channel derived from the multi-channel input audio signal;

quantize the set of first LP filter coefficients using a predefined first quantizer; and quantize the set of second LP filter coefficients on basis of the quantized set of first LP filter coefficients, wherein to quantize of the set of second LP filter coefficients, the apparatus is further caused to:

derive, on basis of the quantized set of first LP filter coefficients by using a predefined predictor, a set of predicted LP filter coefficients for the audio signal in said second channel;

compute prediction error as a difference between respective LP coefficients of the set of second LP filter coefficients and the set of predicted LP filter coefficients; and quantize the prediction error using a predefined second quantizer.

2. An apparatus according to claim 1, wherein each of the set of first LP filter coefficients, the set of second LP filter coefficients and the set of predicted LP filter coefficients comprises a respective set of one of the following:

line spectral frequencies, LSFs; and immittance spectral frequencies, ISFs.

3. An apparatus according to claim 1, is caused to derive the set of predicted LP filter coefficients by computing:

$$\hat{f}_2 = P\tilde{f}_1,$$

wherein $\hat{f}_2$ denotes the set of predicted LP filter coefficients arranged in a respective vector, $\tilde{f}_1$ denotes the set of quantized first LP filter coefficients arranged in a respective vector, and P denotes a predefined predictor matrix of predictor coefficients.

4. An apparatus according to claim 3, wherein the predefined predictor matrix comprises a matrix that has non-zero predictor coefficients only in its main diagonal, in the first diagonal below the main diagonal and in the first diagonal above the main diagonal.

5. An apparatus according to claim 4, wherein the predefined predictor matrix comprises a tri-diagonal matrix where all elements of said main diagonal, said first diagonal below the main diagonal and said first diagonal above the main diagonal are non-zero elements.

6. An apparatus according to claim 4, wherein the predefined predictor matrix comprises a sparse tri-diagonal matrix where each row of the matrix comprises exactly two non-zero elements.

7. An apparatus according to claim 3, wherein the predefined predictor matrix comprises a diagonal matrix that has non-zero predictor coefficients only in its main diagonal.

8. An apparatus according to claim 1, wherein the apparatus is further caused to:

identify the one of two channels of the multi-channel input audio signal that conveys a signal that has a higher energy;

derive the audio signal for the first channel on basis of the signal in the identified one of said two channels; and derive the audio signal for the second channel on basis of the signal in other one of said two channels.

9. An apparatus according to claim 1, wherein the apparatus is further caused to:

derive the audio signal of the first channel as a sum of respective signals in two channels of the multi-channel input audio signal; and derive the audio signal of the second channel as a difference between respective signals in two channels of the multi-channel input audio signal.

10. An apparatus according to claim 1, caused to encode the quantized set of first LP filter coefficients and the quantized prediction error.

11. An apparatus according to claim 1, wherein the apparatus is further caused to:

filter the audio signal in the second channel by using the quantized set of first LP filter coefficients to derive a residual signal;

in response to the energy of the residual signal exceeding a threshold, proceed to quantize the set of second LP filter coefficients on basis of the quantized set of first LP filter coefficients, and in response to the energy of the residual signal not exceeding the threshold, using the quantized set of first LP filter coefficients for the audio signal in the second channel.

12. An apparatus comprising at least one processor; and at least one memory including computer program code, which when executed by the at least one processor, causes the apparatus to:

obtain a reconstructed set of first linear prediction (LP) filter coefficients for an audio signal in a first channel derived from a multi-channel input audio signal; and reconstruct a set of second LP filter coefficients for an audio signal in a second channel derived from the multi-channel input audio signal, wherein in reconstructing the set of second LP filter coefficients, the apparatus is further caused to:

derive, on basis of the quantized set of first LP filter coefficients by using a predefined predictor, a set of predicted LP filter coefficients for the audio signal in said second channel;

reconstruct prediction error on basis of one or more received codewords by using a predefined quantizer; and derive a reconstructed set of second LP filter coefficients as a combination of the set of predicted LP filter coefficients and the reconstructed prediction error.

13. An apparatus according to claim 12, wherein each of the set of first LP filter coefficients, the set of second LP filter coefficients and the set of predicted LP filter coefficients comprises a respective set of one of the following:

line spectral frequencies, LSFs; and immittance spectral frequencies, ISFs.

14. An apparatus according to claim 12, is caused to derive the set of predicted LP filter coefficients by computing:

$$\hat{f}_2 = P\tilde{f}_1,$$

wherein $\hat{f}_2$ denotes the set of predicted LP filter coefficients arranged in a respective vector, $\tilde{f}_1$ denotes the set of quantized first LP filter coefficients arranged in a respective vector, and P denotes a predefined predictor matrix of predictor coefficients.

15. An apparatus according to claim 14, wherein the predefined predictor matrix comprises a matrix that has non-zero predictor coefficients only in its main diagonal, in the first diagonal below the main diagonal and in the first diagonal above the main diagonal.

16. An apparatus according to claim 15, wherein the predefined predictor matrix comprises a tri-diagonal matrix where all elements of said main diagonal, said first diagonal below the main diagonal and said first diagonal above the main diagonal are non-zero elements.

17. An apparatus according to claim 15, wherein the predefined predictor matrix comprises a sparse tri-diagonal matrix where each row of the matrix comprises exactly two non-zero elements.

18. An apparatus according to claim 14, wherein the predefined predictor matrix comprises a diagonal matrix that has non-zero predictor coefficients only in its main diagonal.

19. An apparatus according to claim 12, wherein the first channel conveys an audio signal that is derived on basis of a signal on one of two channels of the multi-channel input audio signal that conveys a higher energy and wherein the second channel conveys an audio signal that is derived on basis of a signal on other one of said two channels of the multi-channel input audio signal.

20. An apparatus according to claim 12, wherein the first channel conveys an audio signal that is derived as a sum of two channels of the multi-channel input audio signal and wherein the second channel conveys an audio signal that is derived as a difference between two channels of the multi-channel input audio signal.

21. A method comprising:

obtaining a set of first linear prediction (LP) filter coefficients for an audio signal in a first channel derived from a multi-channel input audio signal;

obtaining a set of second LP filter coefficients for an audio signal in a second channel derived from the multi-channel input audio signal;

quantizing the set of first LP filter coefficients using a predefined first quantizer; and quantizing the set of second LP filter coefficients on basis of the quantized set of first LP filter coefficients, the quantization of the set of second LP filter coefficients comprising:

deriving, on basis of the quantized set of first LP filter coefficients by using a predefined predictor, a set of predicted LP filter coefficients for the audio signal in said second channel;

computing prediction error as a difference between respective LP coefficients of the set of second LP filter coefficients and the set of predicted LP filter coefficients; and quantizing the prediction error using a predefined second quantizer.

22. A method comprising:

obtaining a reconstructed set of first linear prediction, LP, filter coefficients for an audio signal in a first channel derived from a multi-channel input audio signal; and reconstructing a set of second LP filter coefficients for an audio signal in a second channel derived from the multi-channel input audio signal, said reconstructing comprising:

deriving, on basis of the quantized set of first LP filter coefficients by using a predefined predictor, a set of predicted LP filter coefficients for the audio signal in said second channel;

reconstructing prediction error on basis of one or more received codewords by using a predefined quantizer; and deriving a reconstructed set of second LP filter coefficients as a combination of the set of predicted LP filter coefficients and the reconstructed prediction error.

* * * * *